US007048817B1

(12) United States Patent
Hammond

(10) Patent No.: US 7,048,817 B1
(45) Date of Patent: May 23, 2006

(54) METHOD OF MAKING A COMPOSITE CARTON

(76) Inventor: Ronald J. Hammond, 5138 Bevington Pl., Charlotte, NC (US) 28277

( * ) Notice: Subject to any disclaimer, the term of this patent is extended or adjusted under 35 U.S.C. 154(b) by 0 days.

(21) Appl. No.: 10/662,134

(22) Filed: Sep. 12, 2003

(51) Int. Cl.
*B32B 31/20* (2006.01)

(52) U.S. Cl. ..... 156/64; 156/253; 156/297; 156/299; 53/447

(58) Field of Classification Search ..... 156/64, 156/253, 297, 299; 53/447, 531, 537, 540, 53/541; 206/507, 386, 460; 229/915, 206, 229/207
See application file for complete search history.

(56) References Cited

U.S. PATENT DOCUMENTS

| | | | | |
|---|---|---|---|---|
| 1,541,143 | A | 6/1925 | Hoile | |
| 1,698,699 | A | 1/1929 | Andrews | |
| 1,925,102 | A | 9/1933 | Levkoff | 206/44 |
| 2,448,819 | A | 9/1948 | Mitchell | 206/57 |
| 2,718,301 | A | 9/1955 | Palmer | |
| 2,723,027 | A | 11/1955 | Guyer | |
| 2,842,304 | A | 7/1958 | Ringler | |
| 2,930,516 | A | 3/1960 | Fowle et al. | |
| 2,975,891 | A | 3/1961 | Stone | |
| 3,002,651 | A | 10/1961 | Gauld | 221/34 |
| 3,113,673 | A | 12/1963 | Stein | 206/65 |
| 3,127,991 | A | 4/1964 | Burnett | 206/56 |
| 3,135,457 | A | 6/1964 | Risucci | |
| 3,178,242 | A | 4/1965 | Ellis et al. | 312/45 |
| 3,228,582 | A | 1/1966 | Osberg | 229/51 |
| 3,246,796 | A | 4/1966 | Englander et al. | |
| 3,263,861 | A | 8/1966 | Carr | |
| 3,265,283 | A | 8/1966 | Farquhar | |
| RE26,083 | E | 9/1966 | Forrer | |
| 3,300,115 | A | 1/1967 | Schauer | |
| 3,356,279 | A | 12/1967 | Root | |
| 3,367,556 | A | 2/1968 | Whitby | 229/32 |
| 3,447,733 | A | 6/1969 | Smith et al. | |
| 3,517,858 | A | 6/1970 | Farquhar | |
| 3,540,581 | A | 11/1970 | Koolnis | |
| 3,568,910 | A | 3/1971 | McConnell | 229/17 |
| 3,669,251 | A | 6/1972 | Phillips, Jr. | 206/44 R |
| 3,677,458 | A | 7/1972 | Gosling | |
| 3,765,327 | A | 10/1973 | Vargo | |
| 3,765,527 | A | 10/1973 | Vargo | |
| 3,894,681 | A | 7/1975 | Arneson et al. | |
| 3,912,157 | A | 10/1975 | Graser | |

(Continued)

FOREIGN PATENT DOCUMENTS

| | | |
|---|---|---|
| CA | 874828 | 7/1971 |

(Continued)

*Primary Examiner*—George Koch
(74) *Attorney, Agent, or Firm*—Kennedy Covington Lobdell & Hickman, LLP

(57) ABSTRACT

A method of simultaneously making a plurality of composite cartons from two or more individual cartons on a common assembly surface. A plurality of first singular cartons is positioned in a predetermined array on an assembly surface. Adhesive is positioned at one or more locations on each first singular carton. A plurality of second singular cartons is positioned in a predetermined array adjacent to the array of first singular cartons on the assembly surface such that the adhesive bonds each first carton to a corresponding second carton. The method steps may be repeated. A detector may be used to detect the presence or absence of adhesive. A composite carton comprising three or more individual cartons may be constructed. The individual cartons in the composite cartons may be separable from each other. An object may be positioned between each of the bonded individual cartons in the composite cartons.

43 Claims, 25 Drawing Sheets

U.S. PATENT DOCUMENTS 3,913,739 A 10/1975 Hennessey ..... 206/434
4,000,811 A 1/1977 Hardison et al.
4,030,596 A 6/1977 Snyder et al.
4,042,168 A 8/1977 Kasel et al. ..... 229/40
4,214,660 A 7/1980 Hunt, Jr.
4,222,485 A 9/1980 Focke
4,263,769 A 4/1981 Hanazawa et al.
4,364,509 A 12/1982 Holley, Jr. et al.
4,365,710 A * 12/1982 Swanson ..... 206/386
4,375,258 A 3/1983 Crayne et al.
4,396,143 A 8/1983 Killy
4,416,410 A 11/1983 Herrmann ..... 229/38
4,417,661 A 11/1983 Roccaforte
4,518,115 A 5/1985 Sedwick ..... 229/52
4,582,199 A 4/1986 Schuster ..... 206/428
4,684,058 A 8/1987 Weber ..... 229/17
4,726,471 A 2/1988 Whately et al.
4,913,291 A 4/1990 Schuster
4,919,266 A 4/1990 McIntosh, Jr. et al.
4,974,771 A 12/1990 Lavery
5,123,589 A 6/1992 Cote
5,137,211 A 8/1992 Summer et al.
5,161,732 A 11/1992 Clein et al. ..... 229/117
5,170,934 A 12/1992 Lemoine
5,174,444 A 12/1992 Adams et al.
5,178,268 A 1/1993 Talley et al.
5,178,628 A 1/1993 Otsuka et al.
5,269,645 A * 12/1993 Winski ..... 414/786
5,279,440 A 1/1994 Fougeres et al.
5,368,194 A 11/1994 Oliff et al.
5,427,242 A 6/1995 Oliff et al.
5,465,831 A 11/1995 Smith ..... 206/44 R
5,495,703 A 3/1996 Kruit et al.
5,622,309 A 4/1997 Matsuda et al.
5,647,191 A * 7/1997 Villemure ..... 53/447
5,722,584 A 3/1998 Fujiwara
5,775,574 A 7/1998 Whitnell
5,788,117 A 8/1998 Zimmanck ..... 221/285
5,855,316 A 1/1999 Spivey
5,878,947 A 3/1999 Hoy et al.
5,895,540 A * 4/1999 David et al. ..... 156/226
6,105,854 A 8/2000 Spivey et al.
6,176,419 B1 1/2001 Holley, Jr.
6,283,293 B1 9/2001 Lingamfelter
6,405,913 B1 6/2002 Passamoni ..... 225/43
6,578,736 B1 6/2003 Spivey
2002/0070139 A1 6/2002 Bates
2002/0185499 A1 12/2002 Harrelson et al.
2003/0192907 A1 10/2003 Bates ..... 221/305

FOREIGN PATENT DOCUMENTS

CA 2246020 2/2000
DE 7510538 8/1975
DE 8514718.4 6/1985
DE 36 12 594 A1 10/1987
EP 0 849 189 A1 6/1998
GB 739899 11/1955
GB 2186550 8/1987
JP 7-9721 2/1995
WO WO 96/29260 9/1996
WO WO 97/21607 6/1997

* cited by examiner

METHOD OF MAKING A COMPOSITE CARTON

BACKGROUND OF THE INVENTION

1. Technical Field

The present invention relates to a method of making a carton and more particularly to a method of making a composite carton from two or more separate cartons.

2. Background Information

The desirability of packaging goods in cartons that are created from separate individual cartons or that can be separated into individual cartons is known. Typically, such cartons, which will be referred to herein as "composite cartons", are made using one of two methods. In the first method, a carton blank is constructed having tear lines in predetermined locations. The carton blanks are then folded to create a composite carton, which is filled with product. Tearing the carton along the tear line separates the composite carton into two or more discreet cartons. U.S. Pat. No. 3,677,458 to Gosling, U.S. Pat. No. 4,913,291 to Schuster, and U.S. Pat. No. 3,135,457 to Risucci disclose composite cartons that can be separated into individual cartons by separating the composite carton along a tear line.

A second way in which a composite carton can be constructed is by joining discreet cartons together to produce a composite carton. U.S. Pat. No. 3,447,733 to Smith et al., U.S. Pat. No. 3,912,157 to Graser, U.S. Pat. No. 3,246,796 to Englander et al. and U.S. Pat. No. 5,178,268 to Talley et al. disclose composite cartons that are constructed by joining discreet cartons together by various mechanisms.

While these known methods of constructing composite cartons may have some desirable characteristics, there are associated disadvantages. A first disadvantage associated with previous methods of constructing composite cartons is that composite cartons are constructed one at a time along a production line. The significance of this "series" method of constructing composite cartons is that the overall production speed of the associated product may be limited by the speed at which the carton construction machinery operates.

A second significant disadvantage associated with known methods of constructing composite cartons is that such methods construct the composite cartons on the manufacturing line. Thus, once constructed, the composite cartons must be moved along the production line for further processing, such as being filled with products. Once filled, the composite cartons must be moved to a separate location for distribution.

These two disadvantages of known methods of constructing composite cartons are significant because the production speed and hence production output of the product packaged in the composite cartons may be limited by the speed of the machinery used to create the composite cartons or move the composite cartons along the production line, instead of being limited by the production speed of the goods to be packaged therein. Additionally, because the cartons are constructed in series fashion, the carton-producing machinery must be integrated into the manufacturing process and thus the manufacturing process must include an additional step of moving the constructed cartons to a pallet or other mechanism for eventual movement to a distribution area.

As shown by the above discussion, what is needed in the art is a method of constructing composite cartons that does not impede the product production line speed and that reduces the handling requirements necessary to move the filled cartons from the production line to the distribution processes.

BRIEF SUMMARY OF THE INVENTION

The present invention overcomes the disadvantages associated with known methods of making composite cartons by providing a method of simultaneously constructing a plurality of composite cartons on a common surface, which allows the plurality of composite cartons to be rapidly and efficiently removed from the manufacturing line and taken to the distribution processes.

A plurality of first singular cartons in a predetermined array is positioned on an assembly surface, such as a pallet. Adhesive is deposited at one or more predetermined locations on each first singular carton in the array of first cartons on the assembly surface. A plurality of second singular cartons is positioned en masse in a predetermined array adjacent to the array of first singular cartons on the assembly surface such that the adhesive at each adhesive location on each first singular carton contacts and bonds with a respectively corresponding second singular carton in the array of second singular cartons. The foregoing steps may be repeated a plurality of times. Suitable objects may be positioned between adjacent individual cartons such that the objects are held in position in the resulting composite cartons.

In an embodiment of the present invention, adjacent individual cartons in the composite cartons are separable from each other without substantially degrading the structural integrity of either individual carton.

In an embodiment of the present invention the individual cartons are filled with products such as beverage cans before being positioned on the assembly surface. The first and second individual cartons may be filled with identical or non-identical products.

In an embodiment of the present invention, one or more detectors are used to detect the presence or absence of adhesive in the desired locations. Upon sensing the absence of adhesive at a location, additional adhesive may be applied or an alarm may be activated to alert operators of a possible malfunction.

In an embodiment of the present invention, a plurality of composite cartons each comprised of a first singular carton adhered to a second singular carton adhered to a third singular carton is simultaneously constructed. A plurality of first singular cartons is positioned in a predetermined array of onto an assembly surface. Adhesive is applied at one or more predetermined adhesive locations on each first singular carton. A plurality of second singular cartons is positioned in a predetermined array adjacent to the array of first singular cartons on the assembly surface such that the adhesive at each adhesive location on each first singular carton contacts and bonds with a corresponding second singular carton. Adhesive is deposited at one or more predetermined locations on each second singular carton in the array of second singular cartons on the assembly surface. A plurality of third singular cartons in a predetermined array is positioned adjacent to the array of second singular cartons on the assembly surface such that the adhesive at each adhesive location on each second singular carton contacts and bond with a corresponding third singular carton. The foregoing process steps may be repeated.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

For a more complete understanding of this invention reference should now be had to the embodiments illustrated in greater detail in the accompanying drawings and described below. In the drawings, which are not necessarily to scale.

DESCRIPTION OF THE INVENTION

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. It will be understood that all alternatives, modifications, and equivalents are intended be included within the spirit and scope of the invention as defined by the appended claims.

Figure 1:
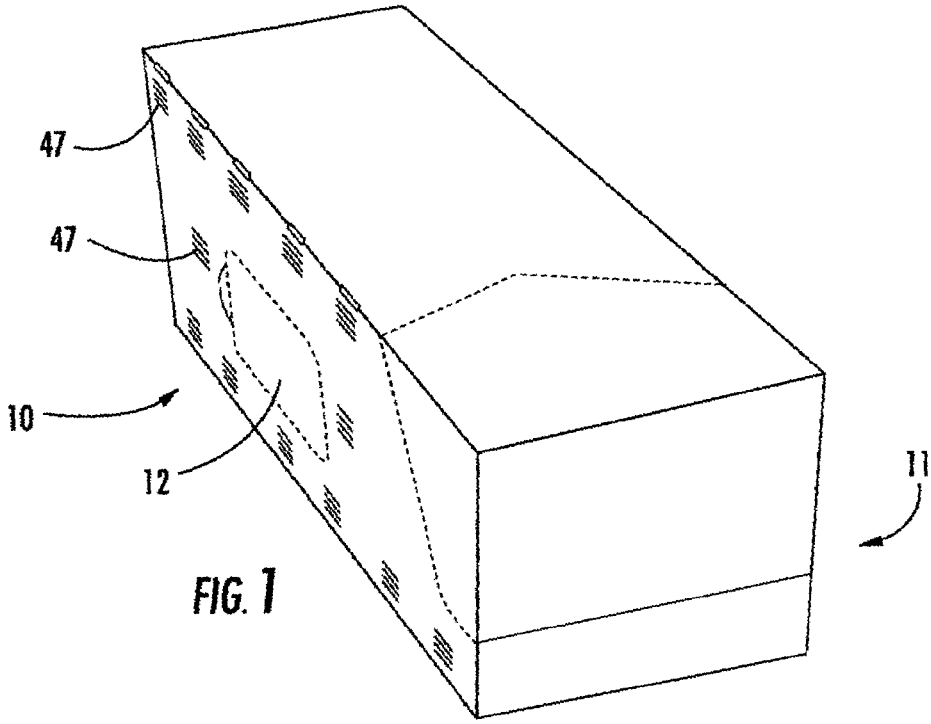
FIG. 1 is a perspective view of an individual carton that may be used in the present method to form a composite carton.

Turning now to the accompanying drawings and initially to FIG. 1, an individual carton suitable for use in the present invention is shown generally at 10. The individual carton 10 typically includes a portion 11 capable of being opened to provide access to the goods packaged inside of the carton. The carton 10 may also include a detachable portion 12.

Figure 1A:
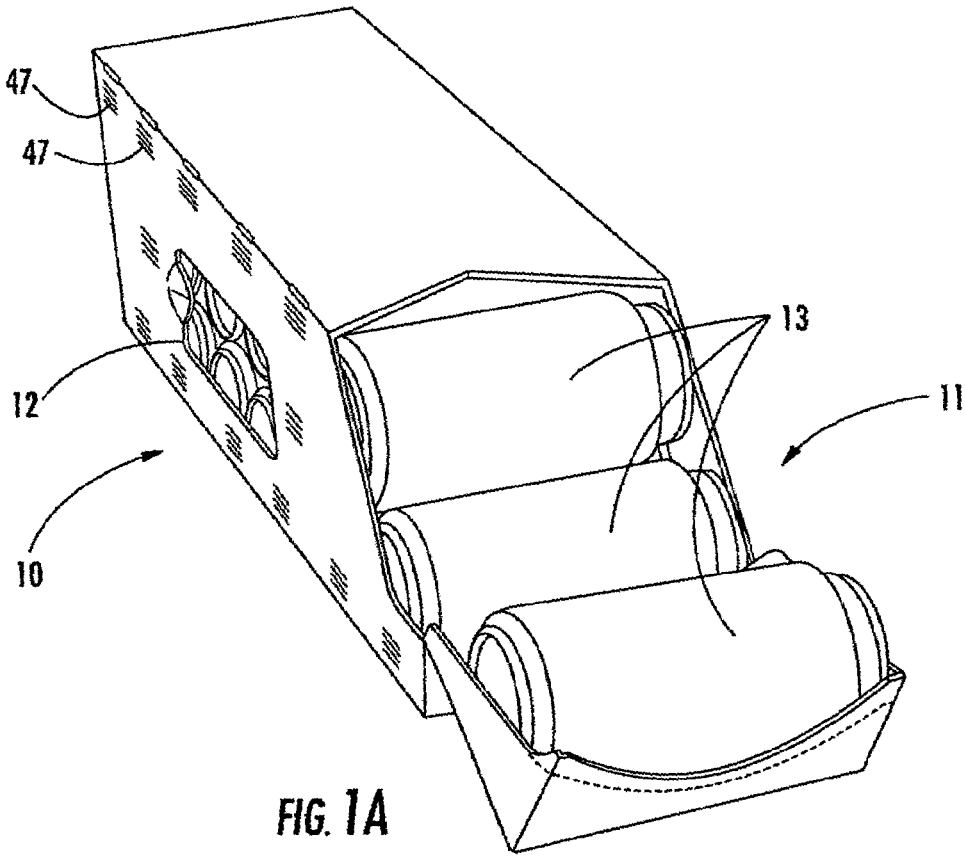
FIG. 1A is a perspective view of the individual carton in FIG. 1 with an end open showing beverage cans inside the individual carton.

FIG. 1A shows the individual carton 10 with the portion 11 open to reveal a plurality of beverage cans 13 packaged inside of the carton 10.

A variety of individual cartons can be used in the present invention to construct composite cartons having many different shapes and sizes. The present invention is therefore not limited to the use of particular individual cartons or to composite cartons having a particular shape or size.

A composite carton for which the present invention is particularly suitable for constructing is the carton disclosed in U.S. Patent Application Publication No. U.S. 2002/0185499 A1, which is incorporated herein by reference and which is owned by the assignee of the present application. Because the present invention is particularly suited to manufacturing such composite cartons, the present application describes and illustrates the present invention using generally rectangular individual cartons. However, as previously mentioned, the present invention is not limited to use with rectangular individual cartons.

Figure 2:
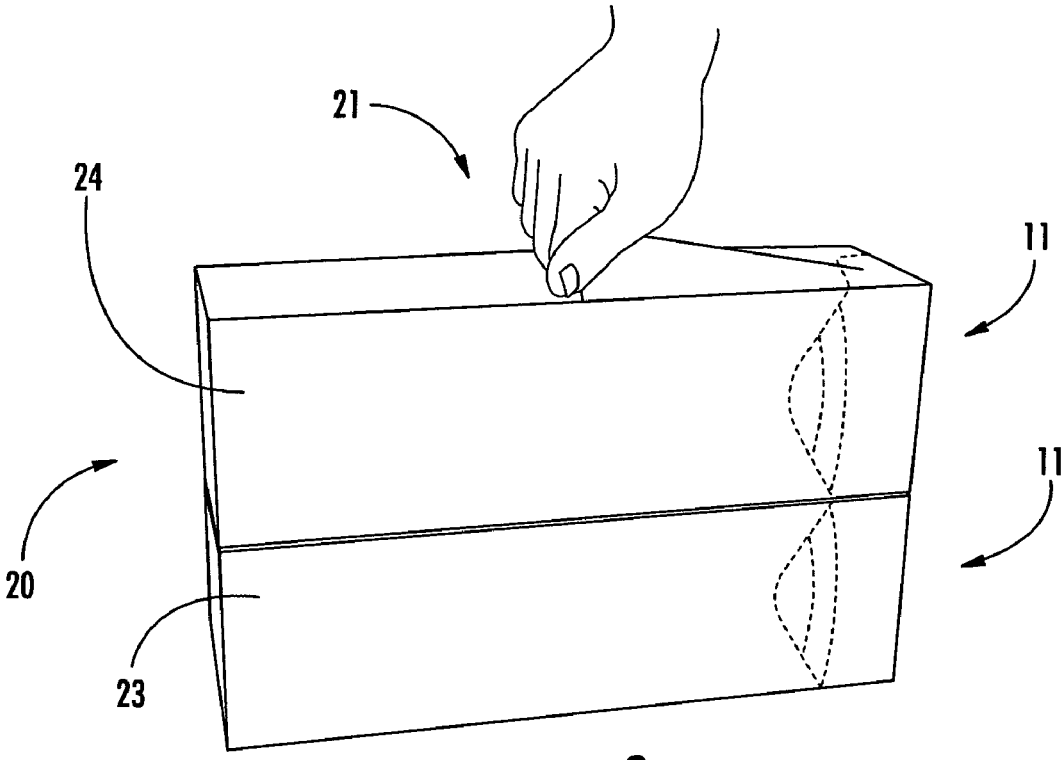
FIG. 2 is a composite carton of the type that can be produced according to the present invention.

FIG. 2 shows a composite carton 20 that can be made using the present invention. The composite carton 20 includes a first carton 23 joined to a second carton 24. A cutout for use as a handle 21 may be provided on the first carton 23, the second carton 24, or on both the first and second cartons. The first carton 23 and the second carton 24 each have an opening portion 11 which, in the case of the illustrated composite carton 20, is comprised of a portion of the first carton and a portion of the second carton having tear lines that can be separated to allow access to the products in the first and second cartons.

Figure 3:
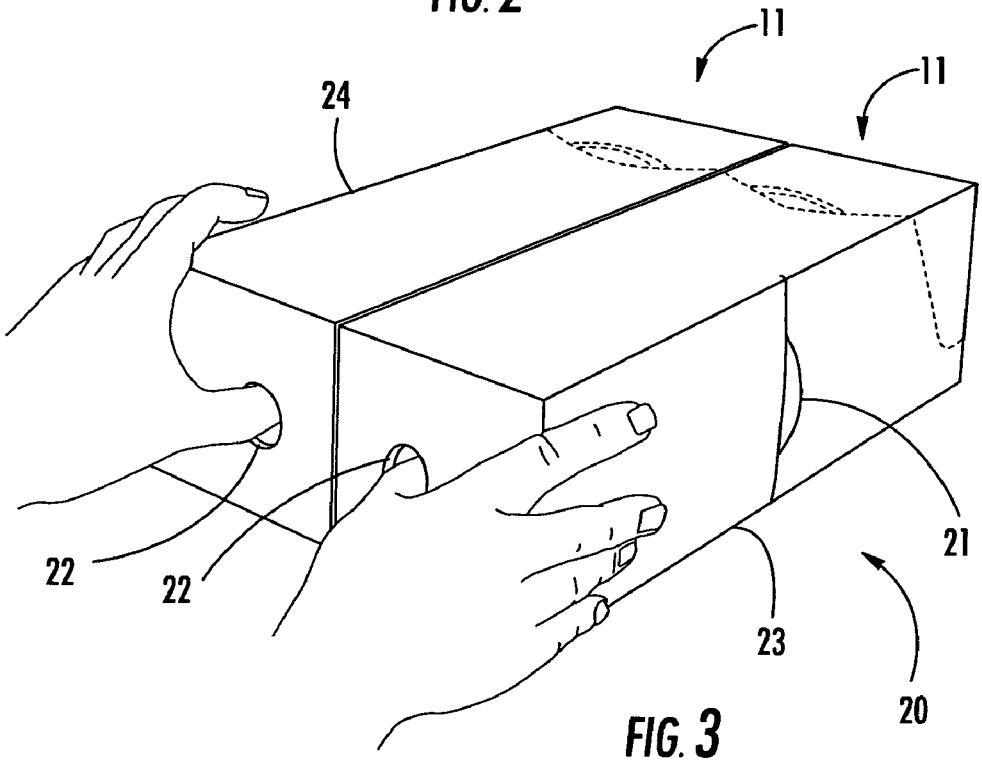
FIGS. 3 and 4 are perspective views illustrating a divisible composite carton that can be made according to the present invention being separated into individual cartons.
Figure 4:
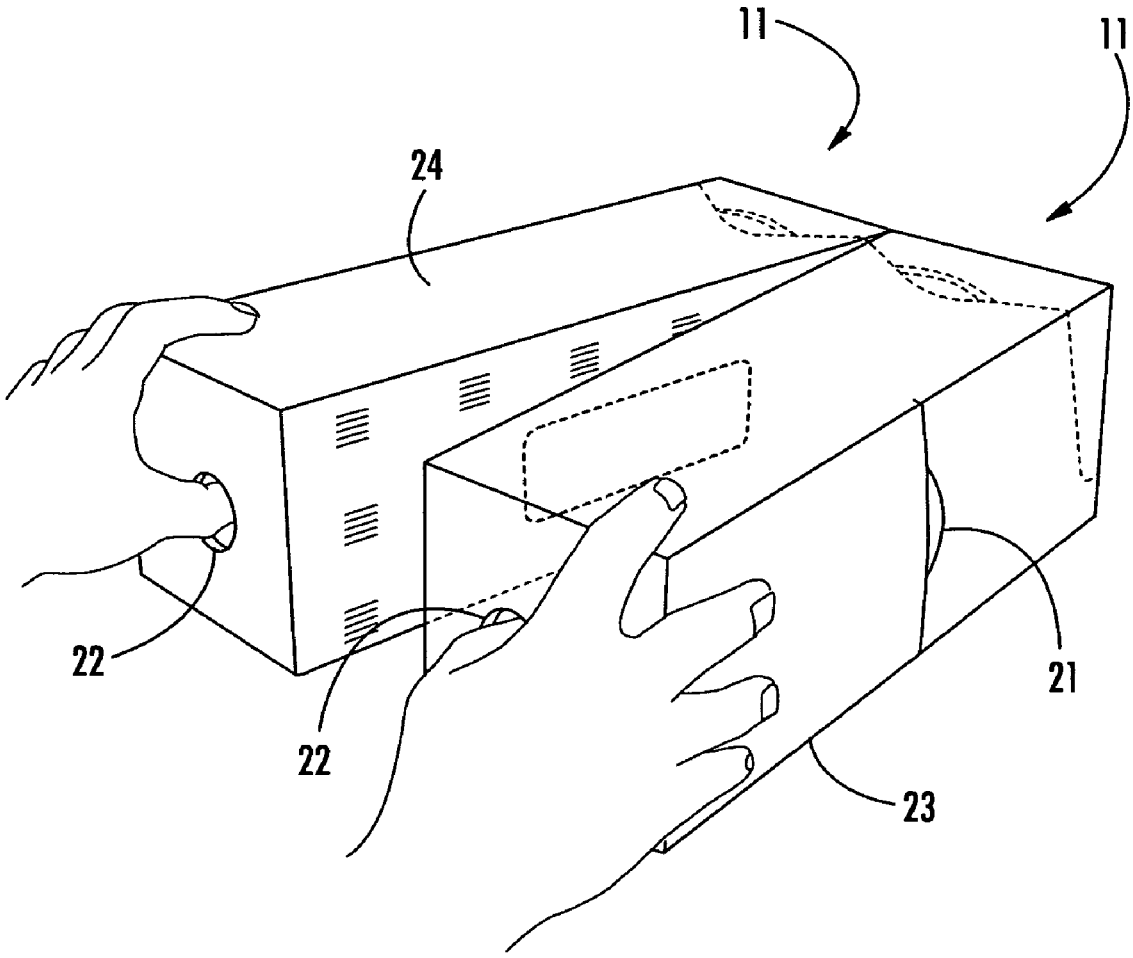

As illustrated in FIG. 3, the present invention may be used to produce a composite carton 20 in which the first carton 23 is separable from the second carton 24. While there are many ways to create such separation, one such way illustrated in FIG. 3 includes the provision of a finger hole 22 in the first carton 23 and in the second carton 24. As shown in FIG. 4, the first carton 23 may be separated from the second carton 24 by pulling the first carton away from the second carton.

Figure 5A:
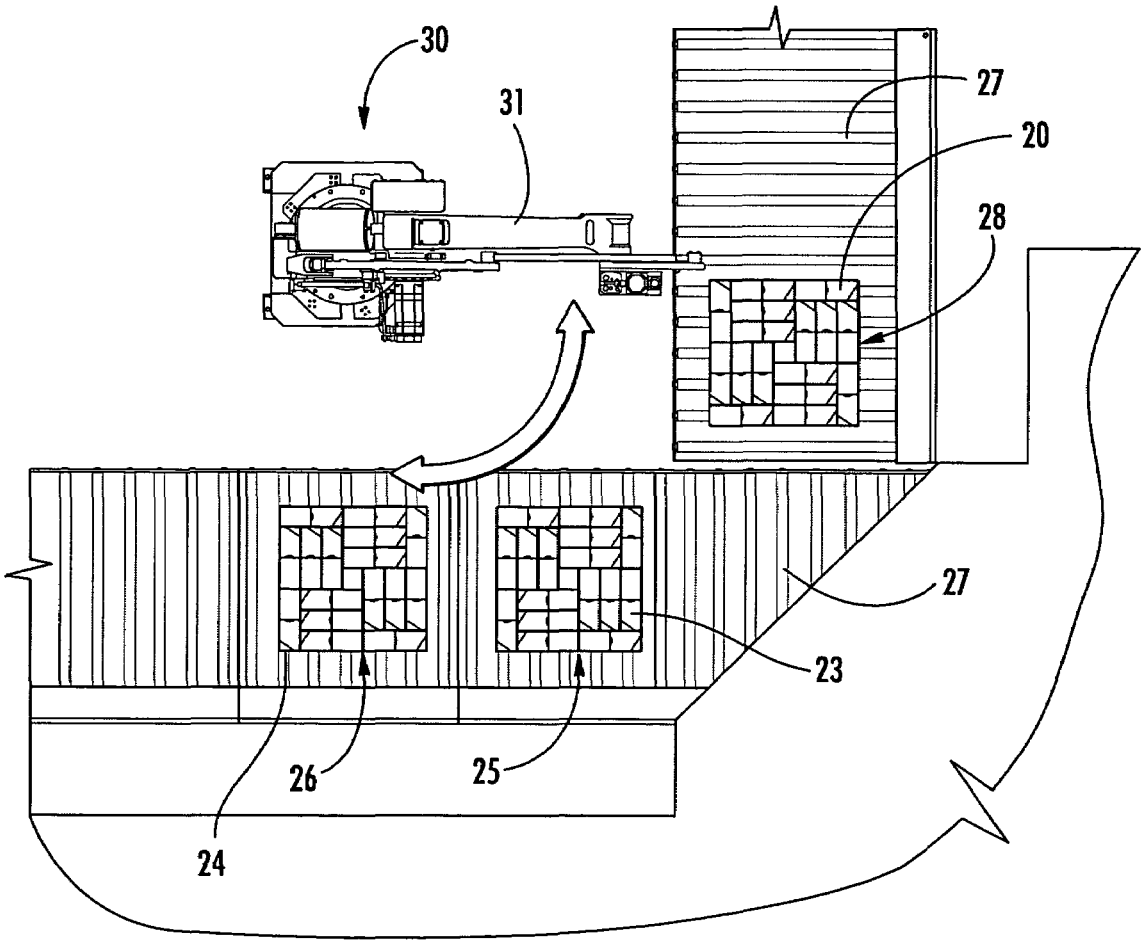
FIG. 5A is a plan view of an embodiment of the present invention in which a robot is used to make the composite cartons.

FIG. 5A illustrates one embodiment of constructing composite cartons 20 according to the present invention, including a supply of first cartons 25, a supply of second cartons 26 and a robot 30 having a robot arm 31. The robot 30 is capable of moving a plurality of first cartons 23 from a supply of first cartons 25 to an assembly surface 28 whereat a plurality of composite cartons 20 will be constructed according to the present invention and as described below. The robot 30 should also be capable of moving a plurality of second cartons 24 from the supply of second cartons 26 to the assembly surface 28.

As used herein, the words "assembly surface" do not necessarily refer to a solid surface but rather to a location capable of supporting a plurality of composite cartons 20 as they are constructed. The assembly surface 28 may consist of a solid surface such as a floor; however, the assembly surface 28 may also consist of surfaces such as a conveyor belt, conveyor rolls 27 as depicted in FIG. 5A, pallets as depicted in FIG. 5B, or supporting chains, as is known in the art.

Figure 5B:
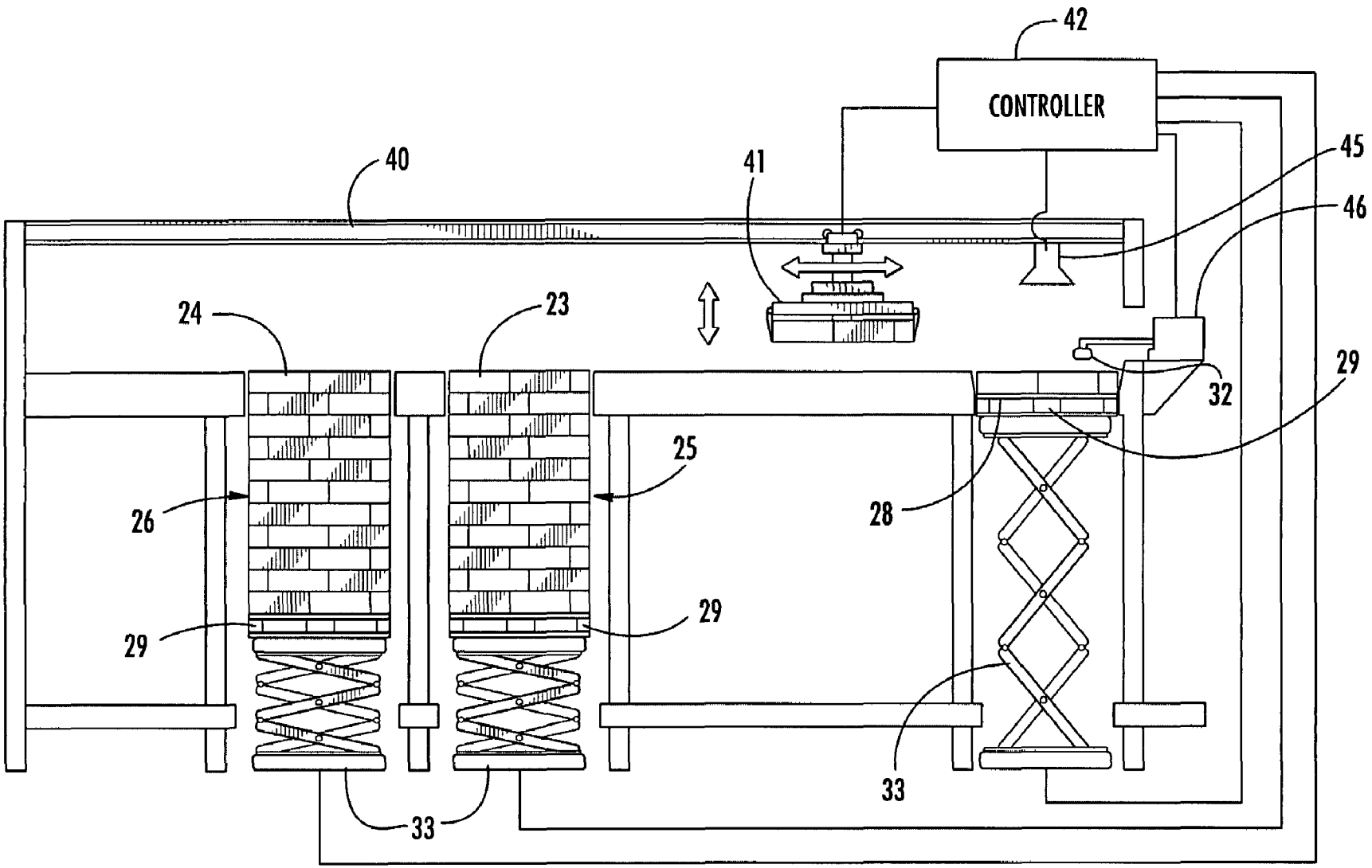
FIG. 5B is a side view of an embodiment of the present invention in which a crane and gantry system is used to make composite cartons.

FIG. 5B illustrates another embodiment of the present invention having a gantry 40 supporting a traveling crane 41 under operation of a controller 42. Gantry supported travelling cranes and associated controllers are well known in the art. In this embodiment, a supply of first cartons 25 is provided on a pallet 29 supported by an elevating mechanism 33 of a type that is known in the art. A supply of second cartons 26 is also supported on an elevating mechanism 33. A pallet 29 provides the assembly surface 28 on which the composite cartons will be constructed according to the present invention as described below.

Also depicted in FIG. 5B is a glue applicator 32 and a glue detector 45. For simplicity, only one such glue applicator and one such glue detector is depicted; however, in practice a plurality of glue applicators 32 or glue detectors 45 may be used. The glue applicators 32 may be stationary or may advantageously be mounted on a travelling glue applicator mechanism 46 that is adapted and positioned to allow the glue applicator 32 or glue applicators 32 to move or "sweep" over the assembly surface 28 in order to efficiently deposit adhesive at adhesive locations 43 as described below. Because glue applicators and travelling glue applicator mechanisms are known in the art, their structure and operation are not described in detail herein. One such known glue applicator that is suitable for use in the present invention is the P904 Glue Delivery applicator manufactured by W.H. Leary Co., Inc. in Mokena, Ill.

FIGS. 6 through 17 illustrate the construction of composite cartons according to the present invention. It should be understood that the present invention may be implemented using a robot system similar to that depicted in FIG. 5A, a gantry and travelling crane system similar to that depicted in FIG. 5B, a stationary or rotating crane system, or any other apparatus capable of performing the disclosed method. The present invention is not, therefore, limited to being implemented by any particular apparatus, or even by an apparatus.

A suitable robot for performing the present invention may be obtained by any one of a number of known robot manufacturers through any one of a number of known robotics integration companies. One robotic system suitable for use in the present invention is the FANUC M-410i HW Robot with System R-J3 Controller, which is manufactured by FANUC Robots North America, Inc. of Charlotte, N.C., and which may be integrated by T-Tek Material Handling, Inc. of Montgomery, Ala.

Figure 6:
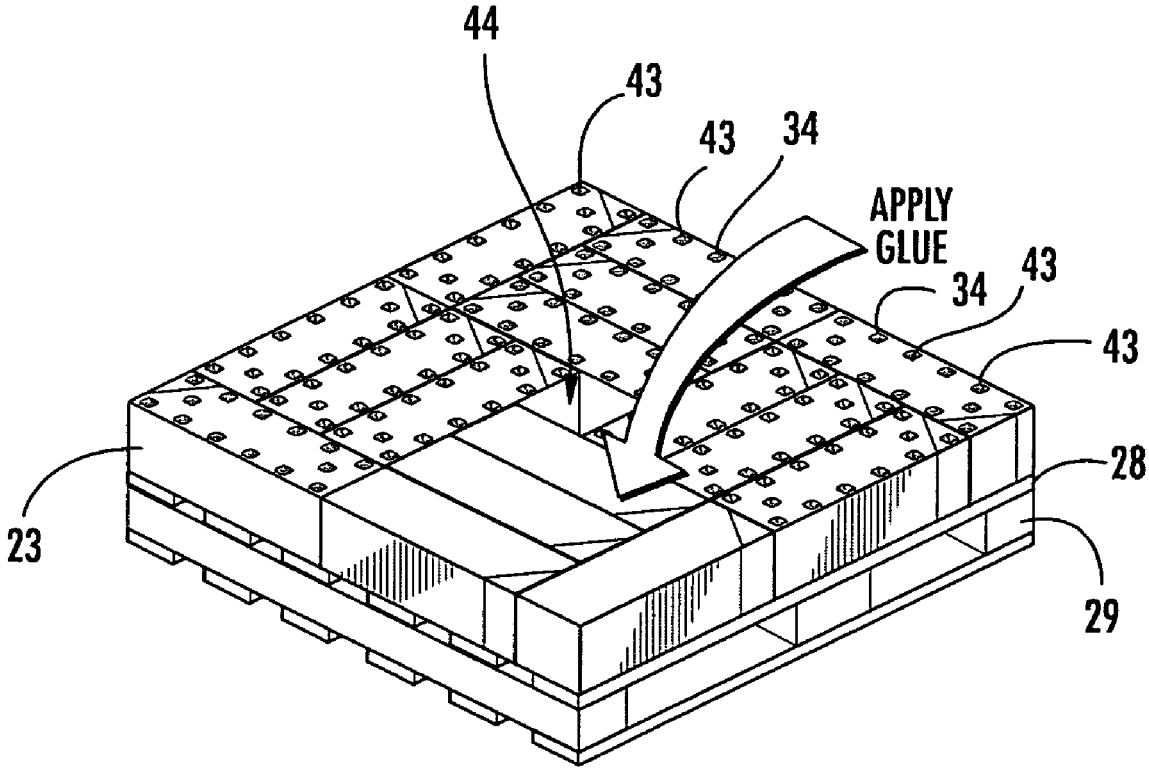
FIGS. 6 through 17 are perspective drawings illustrating the method of making composite cartons according to the present invention.

Turning now to FIG. 6, a plurality of first cartons 23 are positioned from the supply of first cartons 25 onto an assembly surface 28, which is a pallet 29 in FIG. 6. The plurality of first cartons 23 may be positioned on the assembly surface 28 in any desired arrangement or array; however, a particularly desirable array for positioning the first cartons 23 when the present invention is employed to construct the composite cartons described in U.S. Patent Application Publication No. U.S. 2002/0185499 A1 on a pallet 29 is depicted in FIG. 6. In this array, sixteen first cartons 23 are positioned onto the pallet 29 in such a way as to leave a void 44 in the center of the plurality of first cartons 23. While not required in the present invention, the void 44 is particularly useful in that it may facilitate handling of the cartons by apparatus such as "hi-jaws", cranes, robots and the like in which a portion of the apparatus is inserted into the void to provide a solid surface against which the apparatus forces the cartons to hold the plurality of cartons on such apparatus during handling operations.

An adhesive 34 such as glue is deposited on each first carton at one or more predetermined adhesive locations 43 on each first carton 23. The number of adhesive locations 43 and the amount of adhesive 34 deposited on each first carton 23 will vary depending upon such factors as the types of materials comprising the first carton and second cartons, the weight and type of goods contained in the first carton 23 and the second carton 24, whether it is desirable for the first and second cartons to be separable, and other factors as may be desired. It has been determined that a particularly advantageous number of adhesive locations 43 for constructing the composite cartons described in U.S. Patent Application Publication No. U.S. 2002/185499 A1 when used to package 12 oz. beverage cans is fourteen adhesive locations 43 on each first carton 23.

In a typical glue dispensing apparatus, the amount of glue deposited on a particular surface such as a first carton 23 is determined by such factors as the length of time that glue flow is provided to the glue applicator, which is typically controlled by use of a solenoid, the length of time that the travelling glue applicator mechanism remains positioned near each first carton 23 applying glue, the pressure and flow rate of the glue in the glue applicator, and the type of glue used. Control of these factors to achieve a desired amount of glue deposited on each first carton is within the skill of those of ordinary skill in the packaging art.

The amount of adhesive applied to each first carton 23 is governed by whether it is desired to produce a composite carton in which the first carton 23 is not easily separable from the second carton 24 or whether it is desirable that the first carton 23 is easily separable from the second carton 24. If it is desired to produce a composite carton in which the individual cartons are not easily separable, then sufficient glue should be deposited at each adhesive location 43 to ensure that the first carton 23 does not separate from the second carton when the two cartons are pulled outwardly away from each other without tearing the individual first carton 23 or second carton 24. If, on the other hand, it is desired that the first carton 23 be easily separable from the second carton 24 then the amount of glue deposited at each predetermined adhesive location 43 should be sufficient to ensure that the first carton 23 remains securely adhered to the second carton 24 when the composite carton is lifted by either the first carton 23 or the second carton 24 and also remains securely adhered during normal handling of composite carton by distributors and end users. At the same time, however, in order to produce composite cartons 20 in which the first carton 23 is separable from the second carton 24 it is necessary that the amount of glue deposited at each adhesive location 43 does not materially degrade the integrity of either the first carton 23 or the second carton 24 when the first carton 23 is urged away from the second carton 24 by an end user of the composite carton 20.

It has been discovered that when using the present invention for constructing the composite cartons described in U.S. Patent Application Publication No. 2002/185499 A1, satisfactory results are achieved using fourteen 0.2 inch diameter glue deposits on each first carton 23 producing sufficient adhesion to require from 20 pounds to 22 pounds of outward force by an person separating the individual cartons using the finger holes 22 or approximately 60 pounds of separation force to separate the first carton 23 from the second carton 24 when such separation force is exerted by a centrifuge testing apparatus.

When using the present invention to construct composite cartons similar to those described in U.S. Patent Application Publication No. 2002/185499 A1 but comprising three individual cartons containing 8 ounce beverage containers instead of two individual cartons containing 12 once beverage containers, glue deposits should produce sufficient adhesion between adjacent individual cartons to require from approximately 22 pounds to 26 pounds of outward force by an person separating the individual cartons using the finger holes 22 to achieve separate of the individual cartons.

It will be recognized by those in the art that the desired separation force will vary according to such factors as the weight of each filled carton and the carton materials used. Twenty point paperboard has proven a satisfactory carton material for constructing composite cartons described in U.S. Patent Application Publication No. 2002/185499 A1 according to the present invention.

As is known to those in the packaging art, there are two primary types of glue that could be employed in the present invention. One type of glue is a hot melt glue. Hot melt glue is typically employed in production processes because it sets relatively quickly and, at least with respect to paperboard or cardboard cartons, does not typically bond too deeply with the carton fiber material. A second type of glue that could be used is a cold set glue. Cold set glues require more time in which to set than hot melt glues but typically cold set glues form stronger bonds with the fibers of paperboard or cardboard cartons.

It has been discovered that the use of a cold set glue may be more advantageous than use of a hot melt glue when using the present invention to construct a composite carton 20 in which it is desired that the first carton 23 is easily separable from the second carton 24 by an end user of the composite carton 20. It is believed that the cold set glue forms stronger bonds between the first carton 23 and the second carton 24 than would be formed by the use of hot melt glue.

It has also been discovered that providing one or more cuts 47 in the carton materials at the adhesive locations 43 may increase adhesion between adjacent cartons.

A suitable adhesive for use with the present application may be obtained by any one of a number of known adhesive manufacturers. A particularly suitable adhesive for this application is adhesive product 118-60 manufactured by The Reynolds Company of Greenville, S.C., which contains one or more of the following substances as major ingredients: polyvinyl acetate, ethylene vinyl acetate, polyvinyl alcohol and acrylic copolymer.

The number of the adhesive locations 43 is dictated primarily by whether it is desired to produce a composite carton 20 in which the first carton 23 is easily separable from the second carton 24 or in which the first and second cartons are not easily separable. Specifically, adhesive locations 43 should be selected and spaced such that when the first carton 23 is separated from the second carton 24, the cartons separate without tearing or otherwise significantly impairing the structural integrity of either the first carton 23 or the second carton 24. It is understood and acceptable, however, that some surface tearing of the first carton 23 or the second carton 24 may occur during separation and such fiber tearing is acceptable as long as such tearing does not substantially impair the overall structural integrity of either the first carton 23 or the second carton 24.

In recognition of the fact that glue applicators 32 may become clogged, empty or otherwise fail to properly deposit the desired amount of adhesive at each adhesive location 43, one or more glue detectors 45 may advantageously be employed in the present invention to detect the presence or absence of adhesive at each adhesive location 43 immediately after application of the adhesive on a plurality of first cartons 23.

Many types of suitable glue detectors are known in the art. For simplicity of illustration, only a single stationary glue detector 45 is illustrated. As is known, however, a plurality of glue detectors may be used and moving glue detectors may be used. A particularly advantageous arrangement of glue detectors is to collocate a glue detector with each glue applicator 32 as such glue applicators move across each first carton 23.

One advantageous type of glue detector 45 utilizes one or more lights directed over all of the adhesive locations 43 such that glue containing material reactive to such light is made to react in the presence of the light such that one or more ultraviolet sensors of the type that is known in the art may detect the presence or absence of such adhesive. A suitable glue detection system for use in the present invention is the LDu-455 sensor that may be obtained from W. H. Leary Co., Inc. in Mokena, Ill.

A controller 42 may advantageously be operatively connected to the glue detector 45 and the travelling glue applicator mechanism 46 such that when the absence of glue at any adhesive location 43 is detected, additional glue would be deposited at such location or an alarm may sound to inform operators of a potential problem with the glue dispensing system or a particular glue applicator 32.

Figure 7:
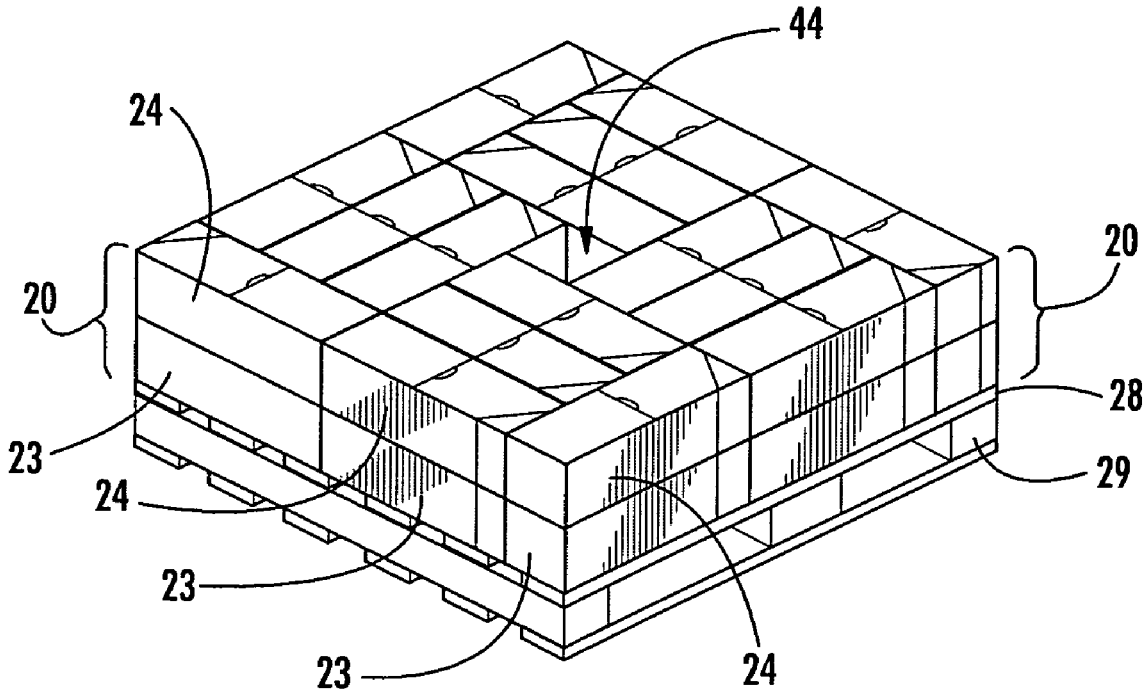

Turning now to FIG. 7, a plurality of second cartons 24 is positioned from the supply of second cartons 26 adjacent to the plurality of first cartons 23 on the assembly surface 28. The adhesive 34 previously deposited on each first carton is thereby positioned between the first cartons 23 and the second cartons 24 on the assembly surface 28. Although the first and second cartons need not contain products to construct a composite carton according to the present invention, it is often desirable for first and second cartons to contain products before being positioned on the assembly surface so that the weight of the products can enhance contact between the second cartons 24 and the first carton 23 and thereby facilitate setting of the adhesive 34 between the adjacent cartons.

It should be noted in FIG. 7 that a plurality of second cartons 24 are positioned on the plurality of first cartons 23 such that each second carton 24 is coextensive with a corresponding first carton 23. While this is often desirable, it is not absolutely required for performance of the present invention. It should also be noted in FIG. 7 that the plurality of second cartons 24 is positioned on the plurality of first cartons 23 in a manner as to preserve the void 44.

Figure 8:
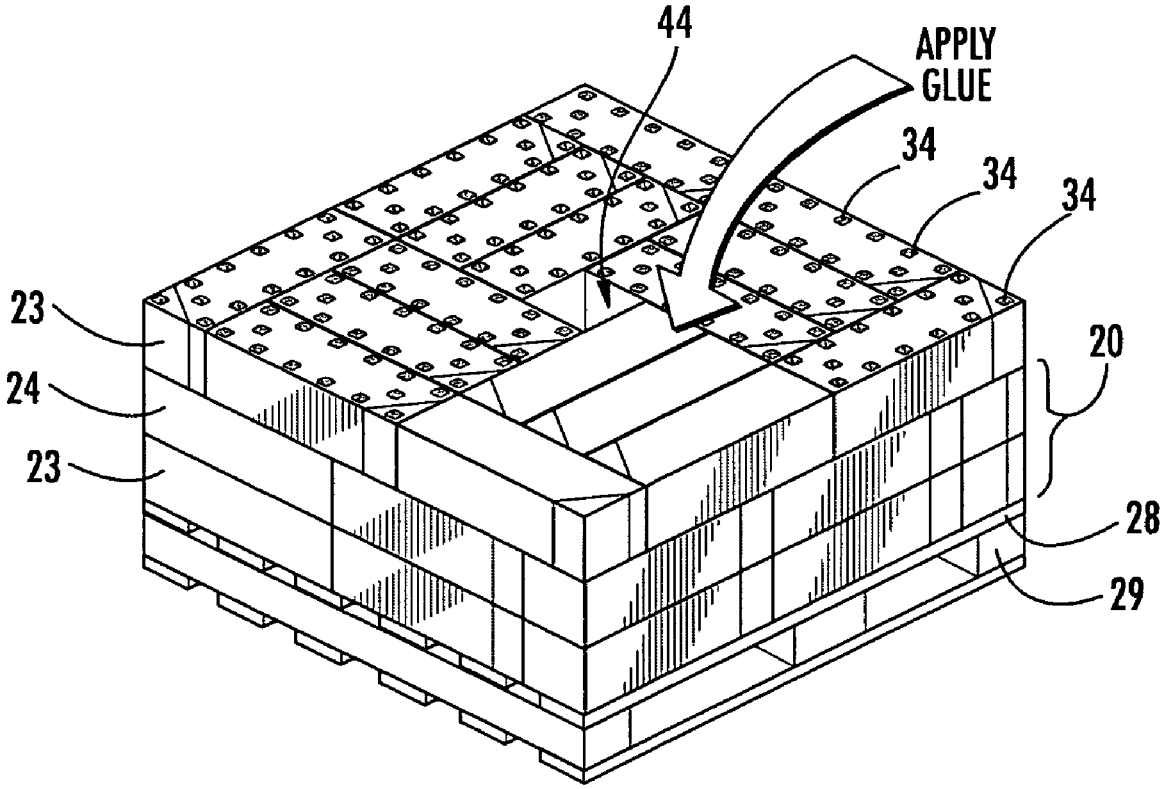

Turning now to FIG. 8, an additional plurality of first cartons 23 is positioned from the supply of first cartons 25 adjacent to the plurality of second cartons 24 on the assembly surface 28. No adhesive is positioned between the plurality of second cartons 24 and the additional plurality of first cartons 23 in the assembly surface 28.

After the additional plurality of first cartons 23 is placed adjacent to the plurality of second cartons on the assembly surface 28, adhesive 34 is deposited at predetermined adhesive locations 43 on each first carton 23 in the additional plurality of first cartons 23.

It should be noted in FIG. 8 that the additional layer of first cartons 23 is adjacent to the layer of second cartons 24 previously positioned on the assembly surface 28; however, the first cartons 23 in the additional layer of first cartons are not coextensive with the adjacent second cartons 24. While the first cartons 23 in the additional layer of first cartons could be positioned such that all cartons are coextensive with the adjacent cartons, it has been found that varying the positioning of layers of first and second cartons on a pallet 29 contributes to increased pallet stability. Specifically, it has been discovered that positioning subsequent layers of first cartons 23 on a pallet 29 such that the additional layers of first cartons are offset 90° about an imaginary vertical axis located in the center of the void 44 from the previously deposited layer of first cartons, and then positioning subsequent layers of second cartons 24 to be coextensive with the subsequent layers of first cartons 23, is particularly advantageous. This arrangement is referred to herein as a "pinwheel" arrangement and is depicted in FIGS. 6–18.

Adhesive 34 is then deposited at preselected adhesive locations 43 on each first carton 23 in the additional layer of first cartons 23.

Figure 9:
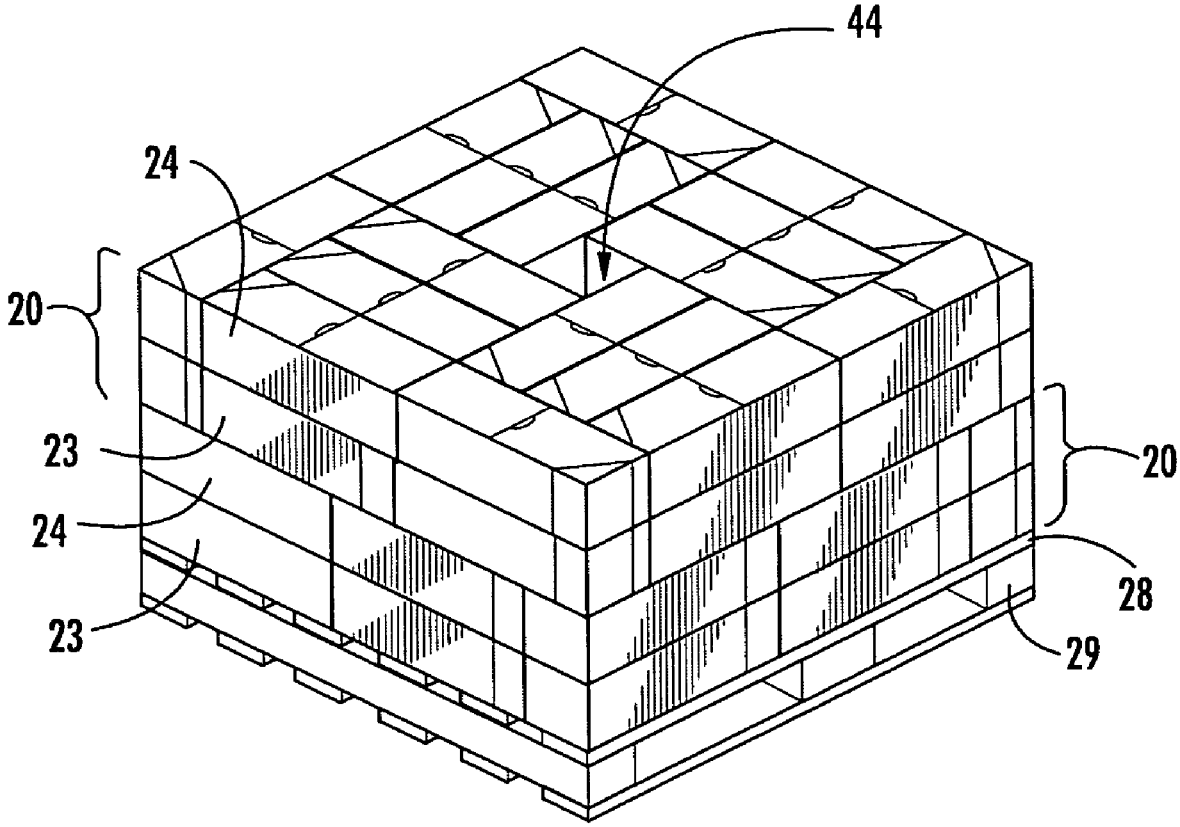
Figure 10:
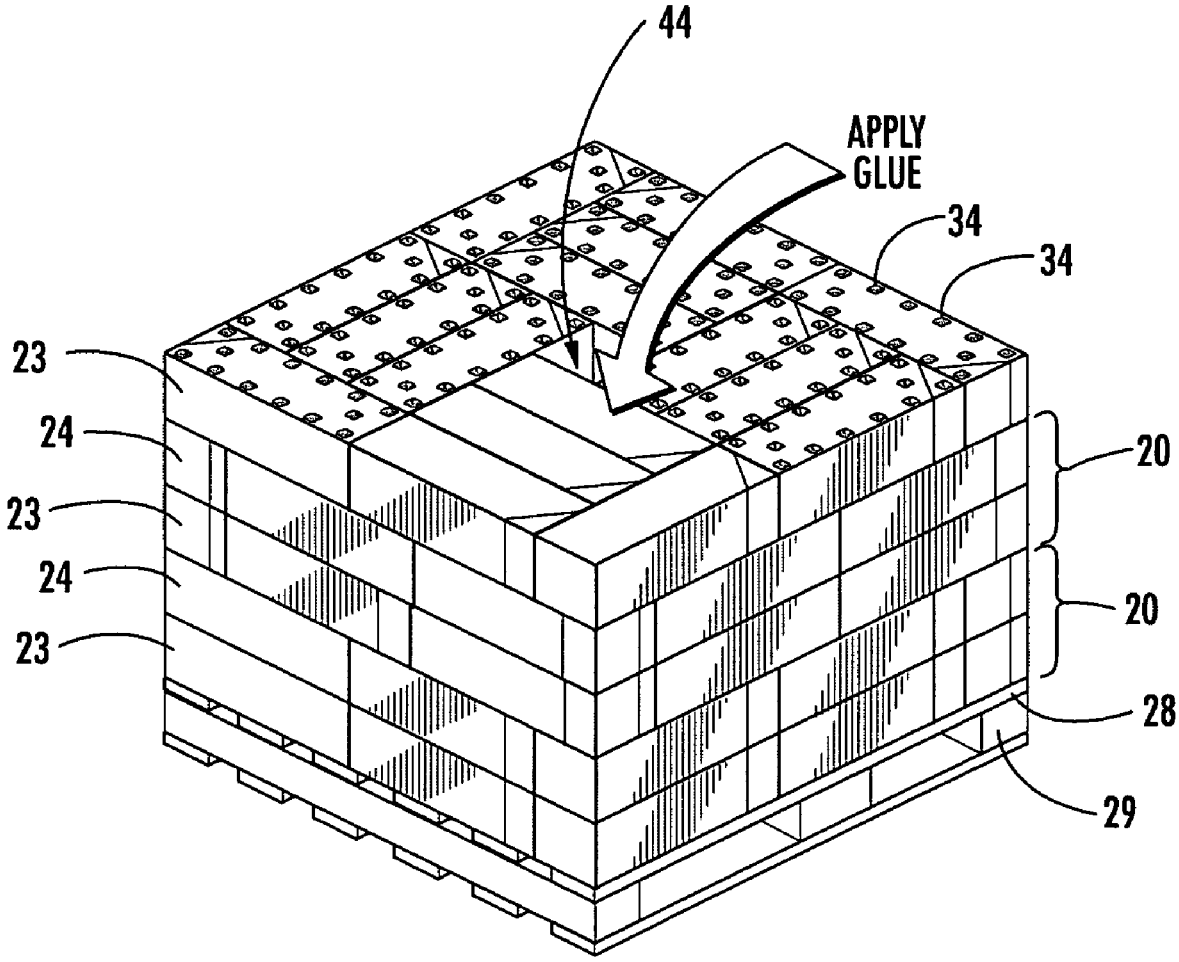
Figure 11:
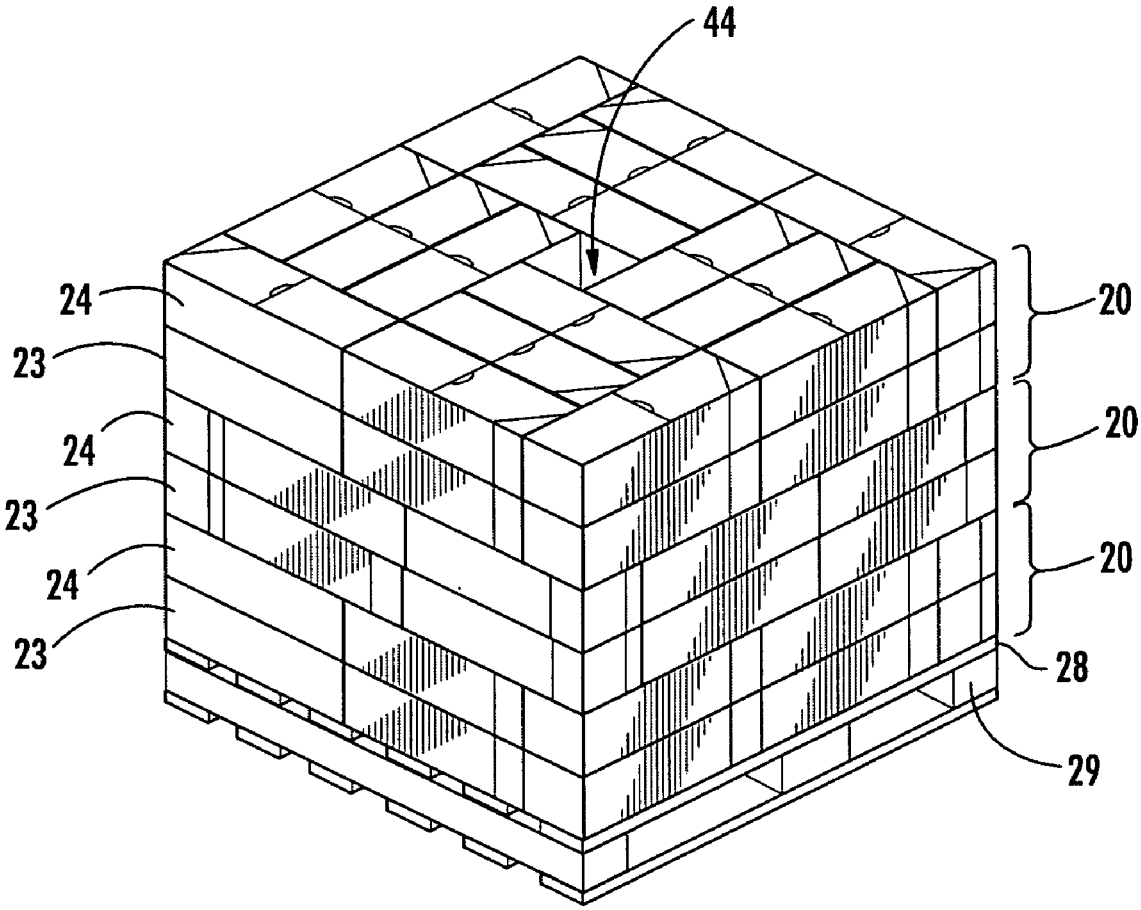
Figure 12:
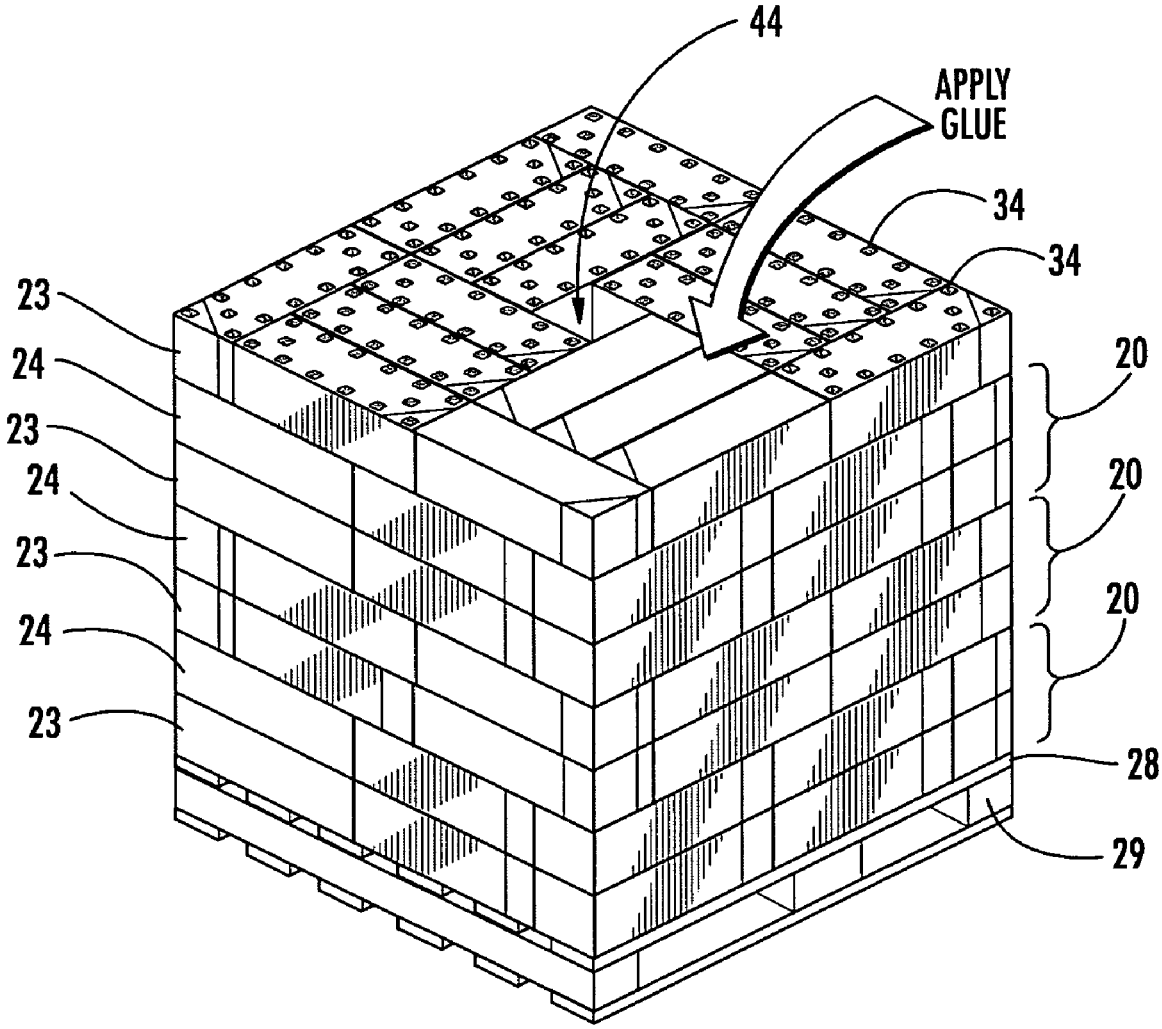
Figure 13:
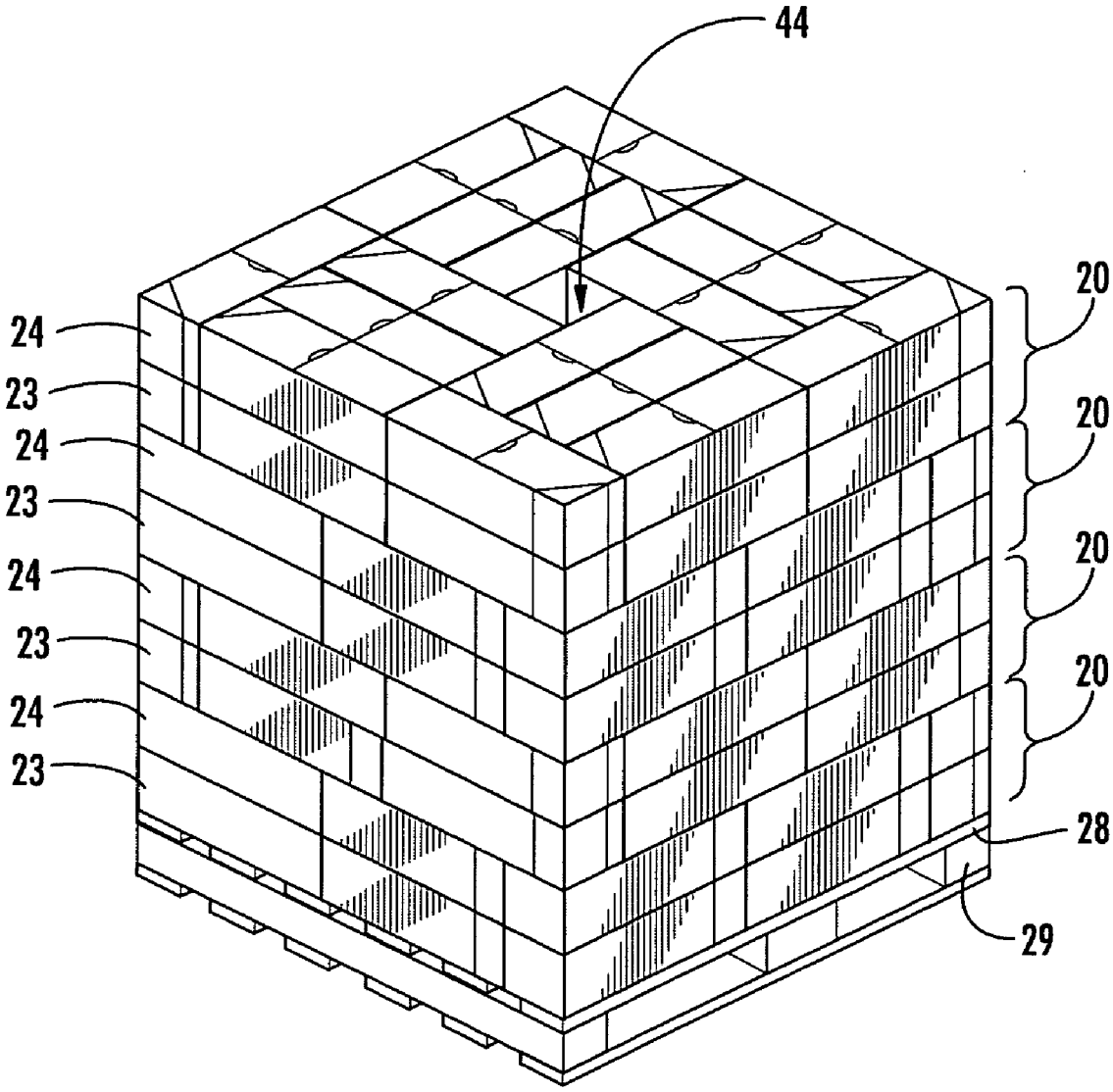
Figure 14:
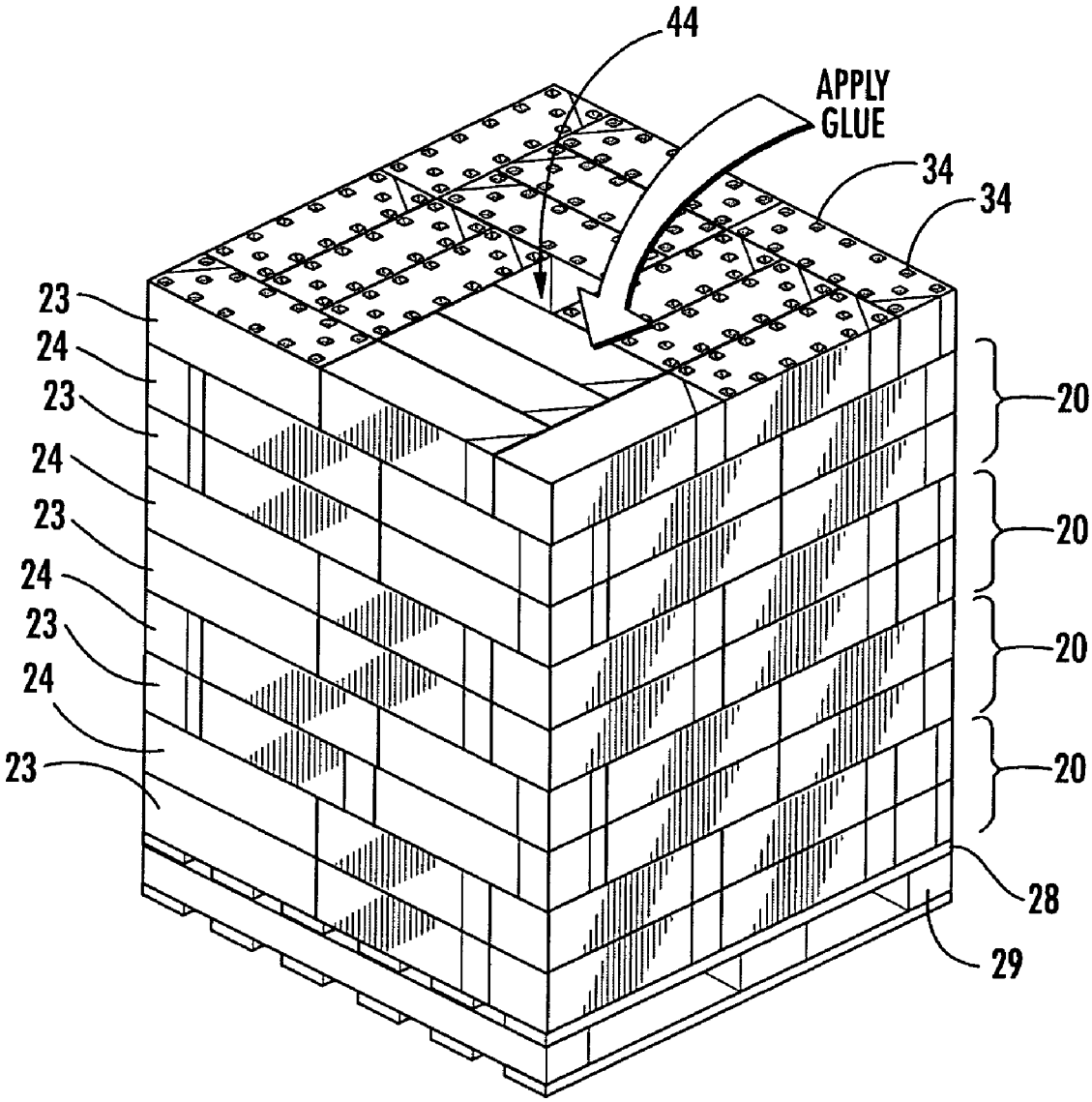
Figure 15:
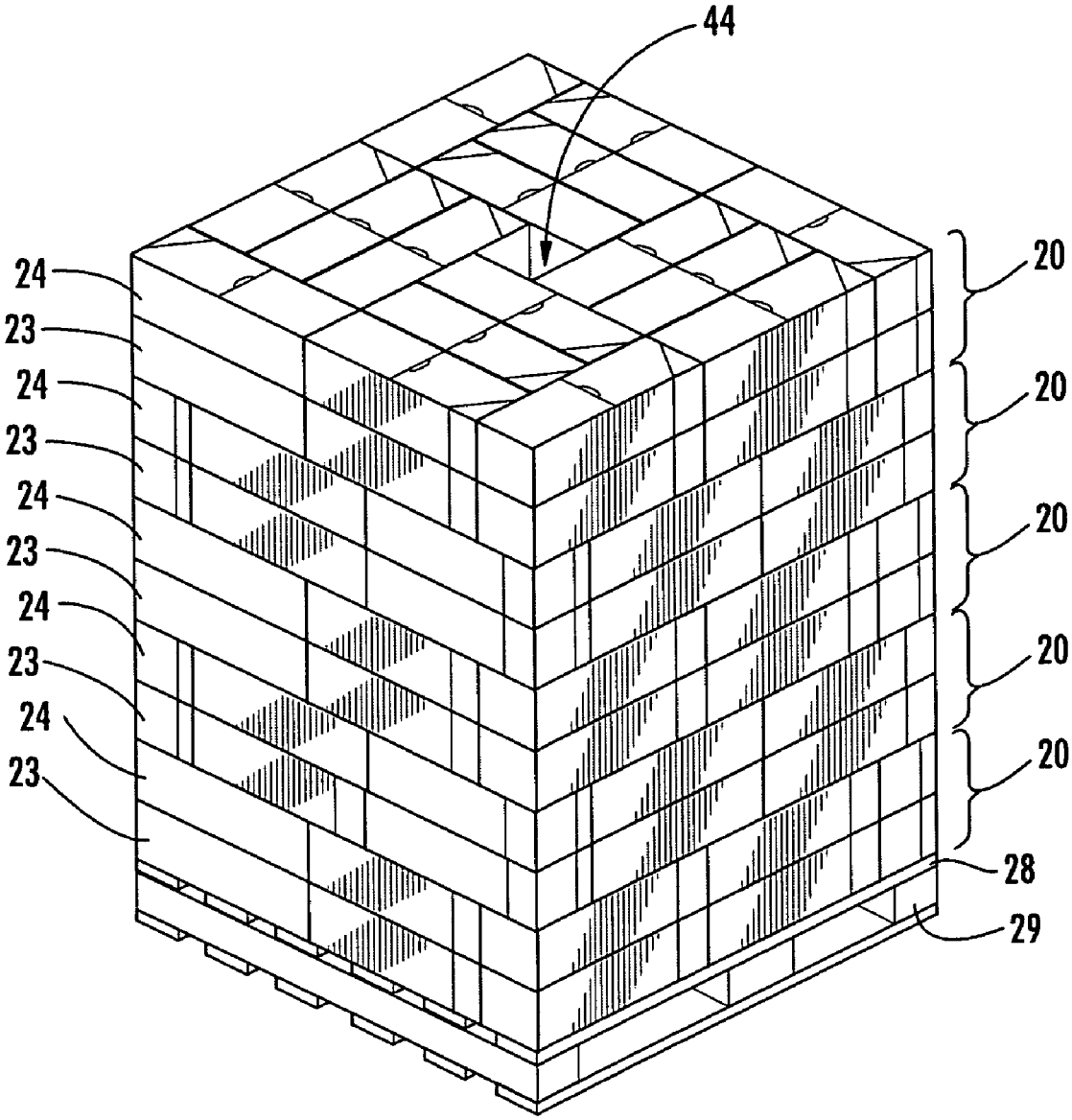
Figure 16:
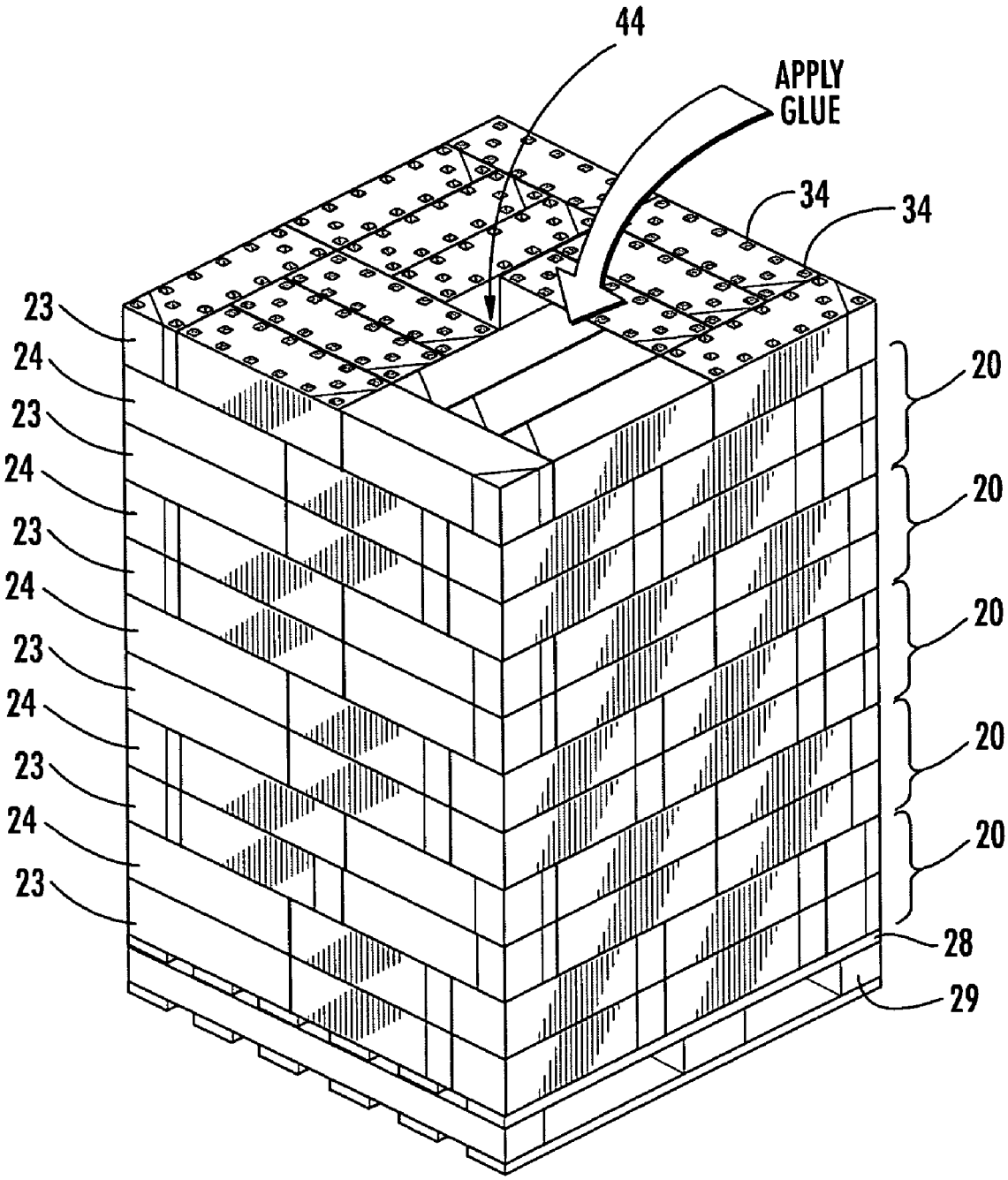

As illustrated in FIG. 9, an additional layer of second cartons 24 is positioned adjacent to the additional layer of first cartons 23 on the assembly surface 28 such that the adhesive 34 that was previously deposited at adhesive locations 43 on each first carton 23 of the additional layer of first cartons is thereby contained between the additional layer of second cartons 24 and the additional layer of first cartons 23.

Figure 17:
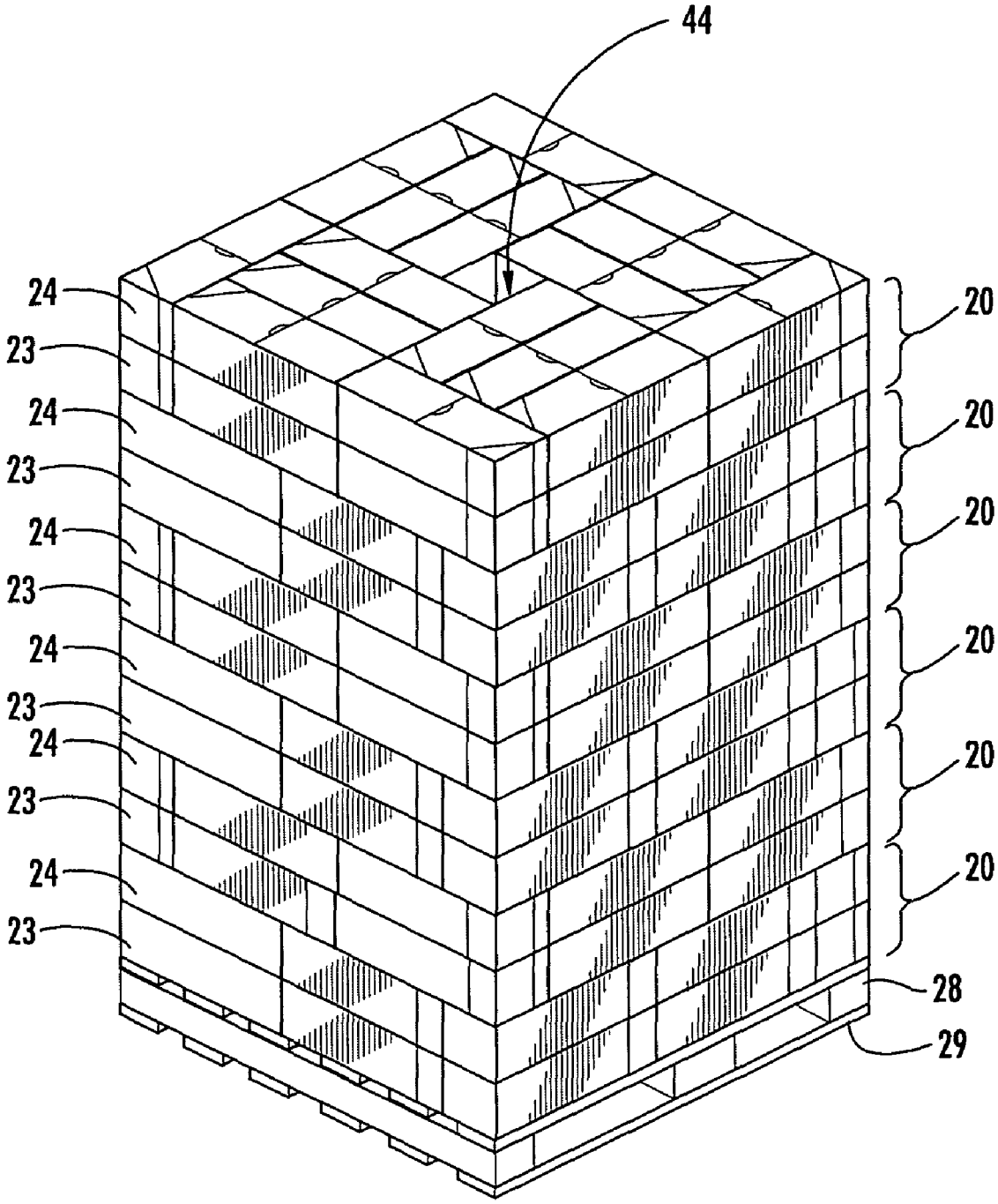

FIGS. 10 through 17 illustrate the repetition of the previously described process of constructing composite cartons on an assembly surface 28. While the aforedescribed process can be repeated as many times as desired, it has been found that when constructing composite cartons such as those disclosed in U.S. Patent Application Publication No. U.S. 2002/0185499 A1 on a pallet, it is advantageous to cease the process steps of the present invention for a particular pallet when twelve layers of individual cartons, six layers of first cartons 23 adhered to six layers of second cartons 24, have been positioned on the pallet 29, as illustrated in FIG. 17. FIG. 17 also indicates the resulting pinwheel configuration. This twelve-layer "pinwheel" arrangement has been found to result in satisfactory pallet stability during transit of the loaded pallet 29.

Figure 18:
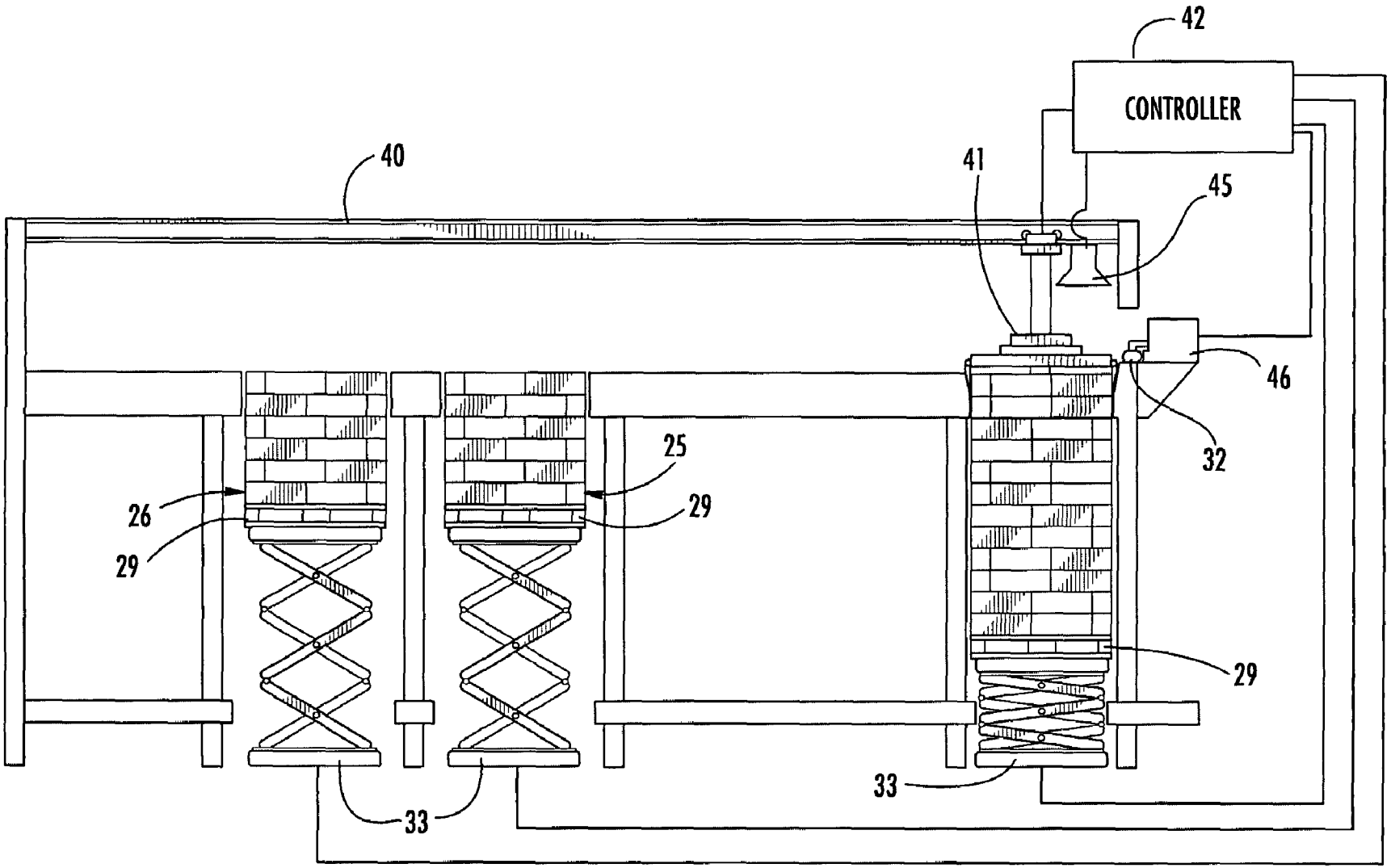
FIG. 18 is a side view of an embodiment of the present invention illustrating the use of elevating devices to maintain the supply of individual cartons and the composite cartons at a predetermined height.

Referring now to FIG. 18 and FIG. 5B, it will be observed that elevating mechanisms 33 may be employed in the present invention to control the loading and unloading positions of the supply of first cartons 25, the supply of second cartons 26, and the assembly surface 28. Such elevating mechanisms are known in the pallet loading art and are typically controlled by operation of a controller 42, which is electrically connected to each elevating mechanism 30 as well as to the crane 41 or robot 30 (in the embodiment in which a robot is used instead of a crane). Use of elevating mechanisms 33 is advantageous in that elevating mechanisms 33 maintain the position of the next available layer of first cartons 23 and second cartons 24 at a constant position relative to a reference point, which may be the gantry 40, the robot 30, the floor upon which the elevating mechanisms are located, or some other desired reference point. An elevating mechanism 33 may also be used to adjust the assembly surface 28 to ensure that first and second cartons are deposited on the assembly surface 28 at a constant location relative to an external reference point. It should be understood while the elevating mechanisms 33 are illustrated with respect to the embodiment of the present invention in which a gantry and travelling crane apparatus are used, elevating mechanisms 33 may also be used in embodiments of the present invention in which a robot 30 or a stationary crane or any other carton handling apparatus is used.

Those in the art will recognize that the use of known squaring bar mechanisms for positioning cargo on pallets may be advantageously employed in the present invention to stabilize the individual cartons on the supply pallets or to stabilize the composite cartons on the assembly surface pallet.

Also illustrated in FIG. 18 and FIG. 5B is that the glue applicator 32 or glue applicators 32 can advantageously be moved between an operating position illustrated in FIG. 5B and a nonoperating position illustrated in FIG. 18 in which the glue applicator 32 is positioned so as not to interfere with the positioning of first and second cartons on the assembly surface. If glue detectors are also used, then such detectors may be collocated on the traveling glue applicator mechanism 46 or may be stationary.

Figure 19A:
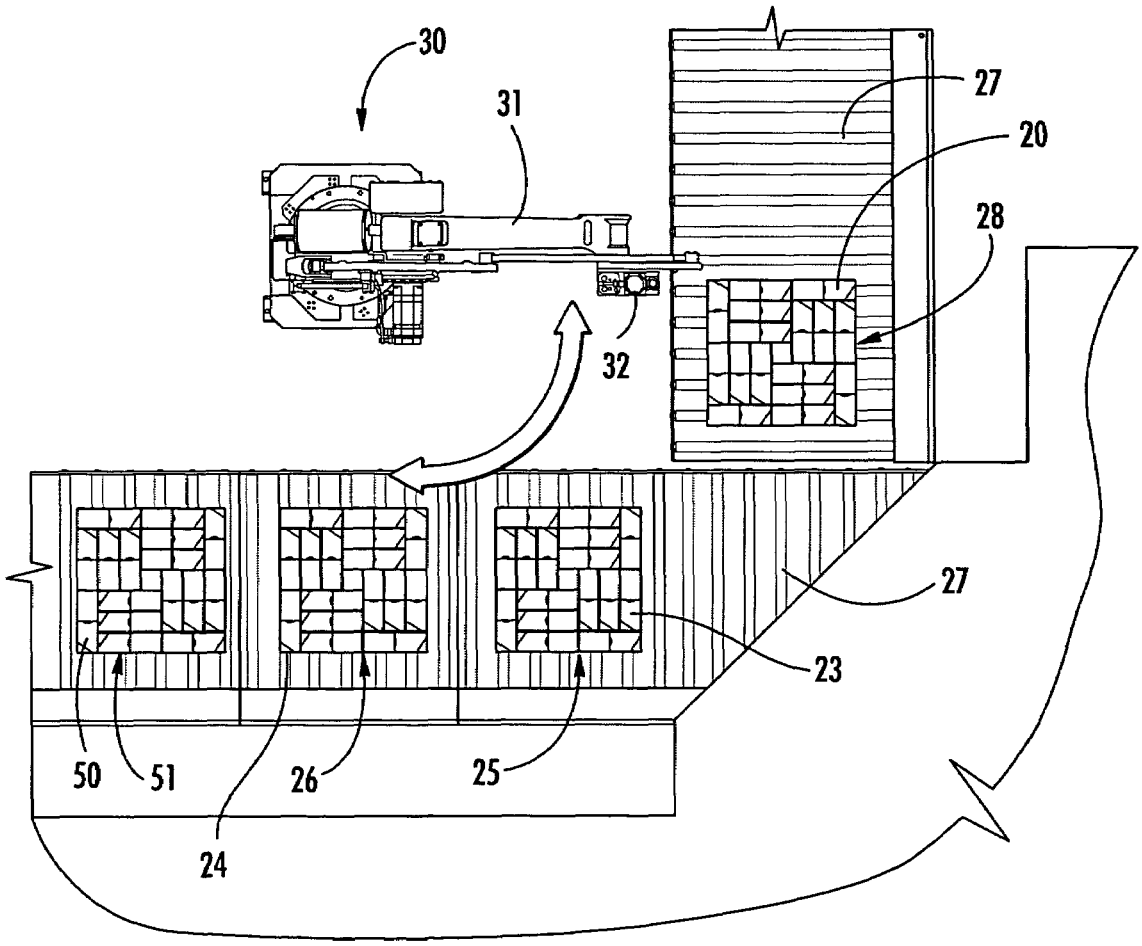
FIG. 19A is a plan view illustrating an embodiment of the present invention in which a robot is used to construct a composite carton from three individual cartons.
Figure 19B:
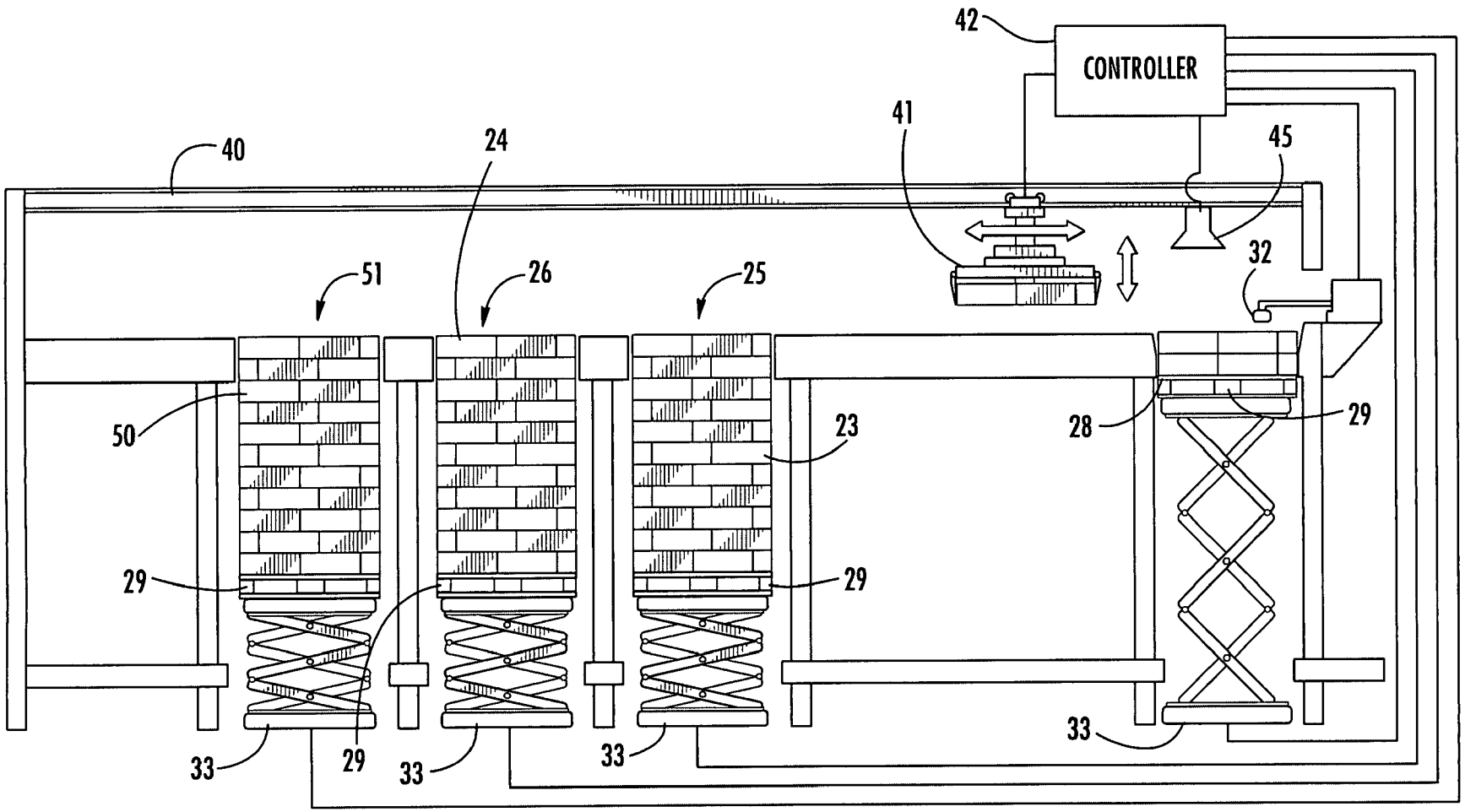
FIG. 19B is a side view of an embodiment of the present invention in which a gantry and crane system is used to make composite cartons from three individual cartons.

FIGS. 19A and 19B illustrate an embodiment of the present invention in which a plurality of composite cartons 20 are produced from a supply of first cartons 25, a supply of second cartons 26, and a supply of third cartons 51. As with the previously described embodiments of the present invention, the embodiment illustrated in FIGS. 19A and 19B may utilize a robot 30, a travelling crane 41, or other apparatus suitable for positioning a plurality of cartons from respective carton supplies onto an assembly surface 28, which may be a conveyor 27, a pallet 29, a chain or other surface capable of supporting the cartons and products contained therein.

Figure 20:
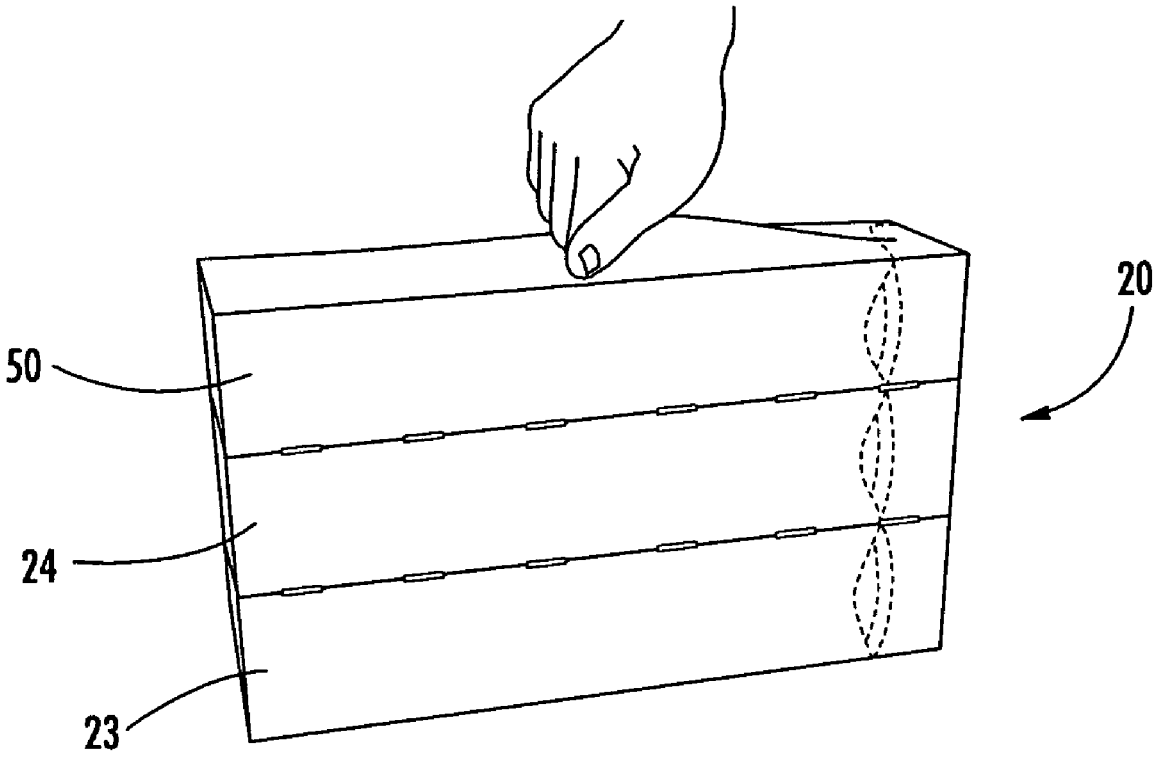
FIG. 20 is a perspective view showing a composite carton that can be constructed from three individual cartons according to the present invention.

FIG. 20 illustrates a composite carton 20 produced according to the embodiment of the invention illustrated in FIGS. 19A and 19B. The composite carton 20 illustrated in FIG. 20 includes a first carton 23 which is adhered to a second carton 24 which is adhered to a third carton 50. While not specifically illustrated, the first carton 23 and the third carton 50 may be separable from the second carton 24 in the same manner as described above.

Figure 21:
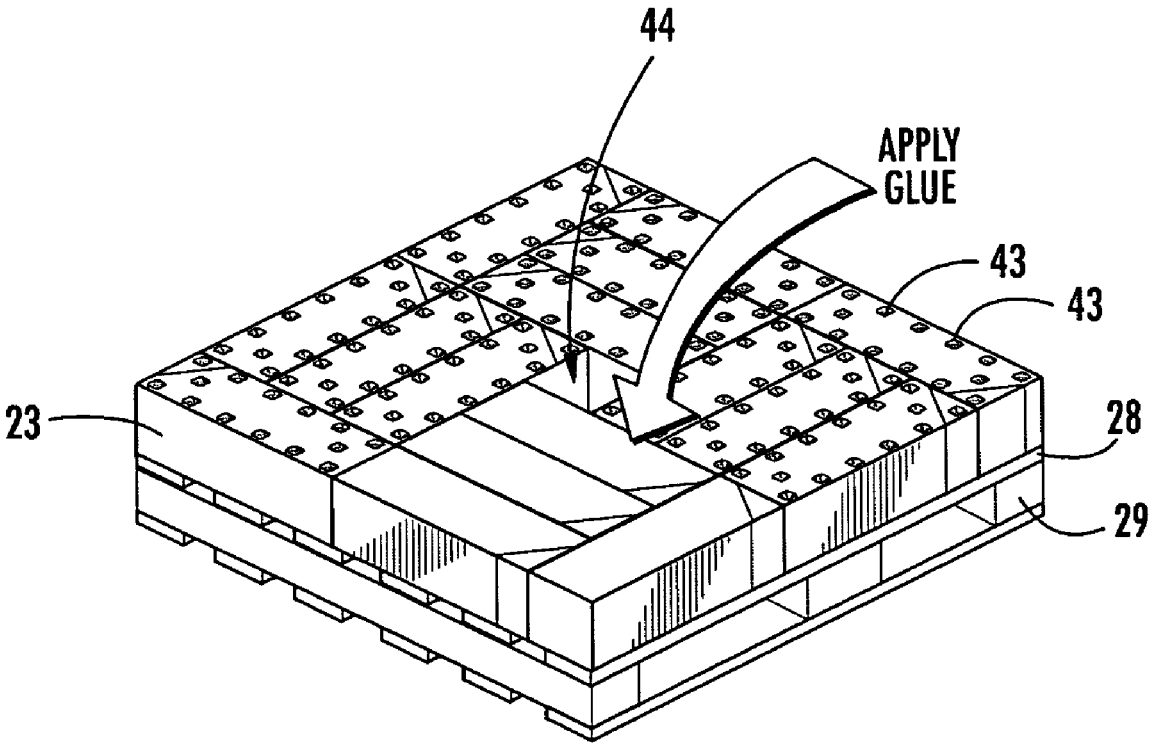
FIGS. 21 through 23 illustrate a method of making a composite carton from three individual cartons according to the present invention.
Figure 22:
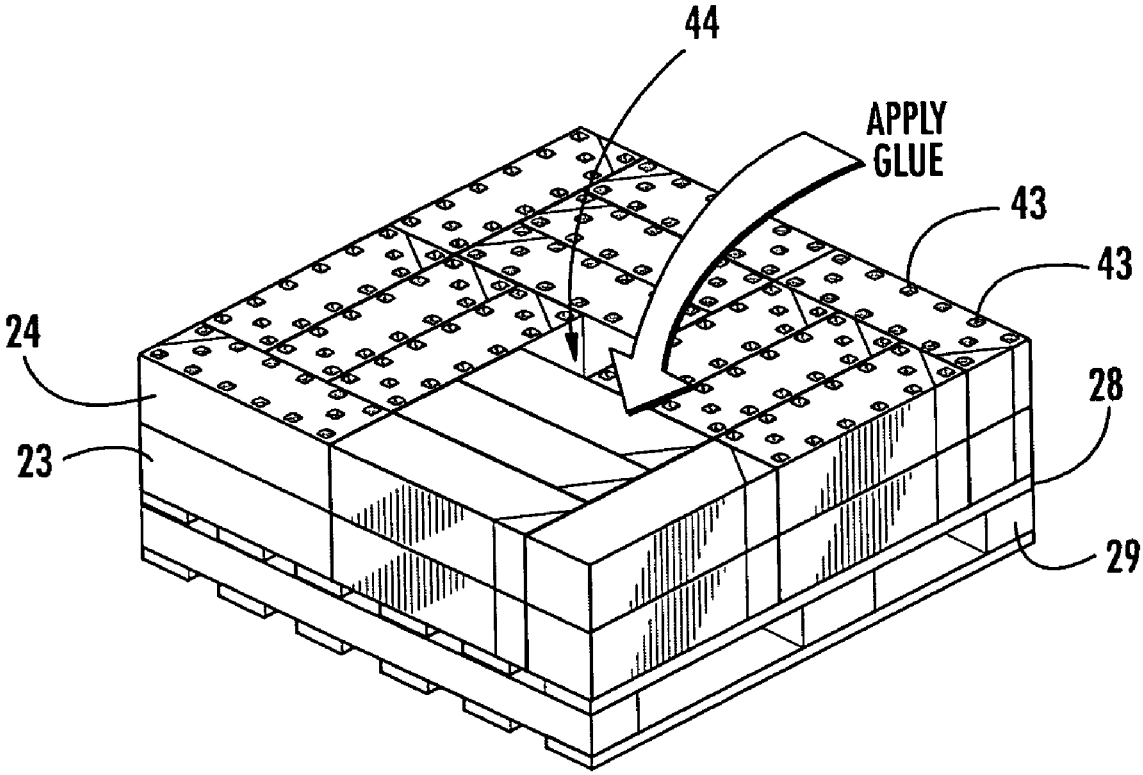
Figure 23:
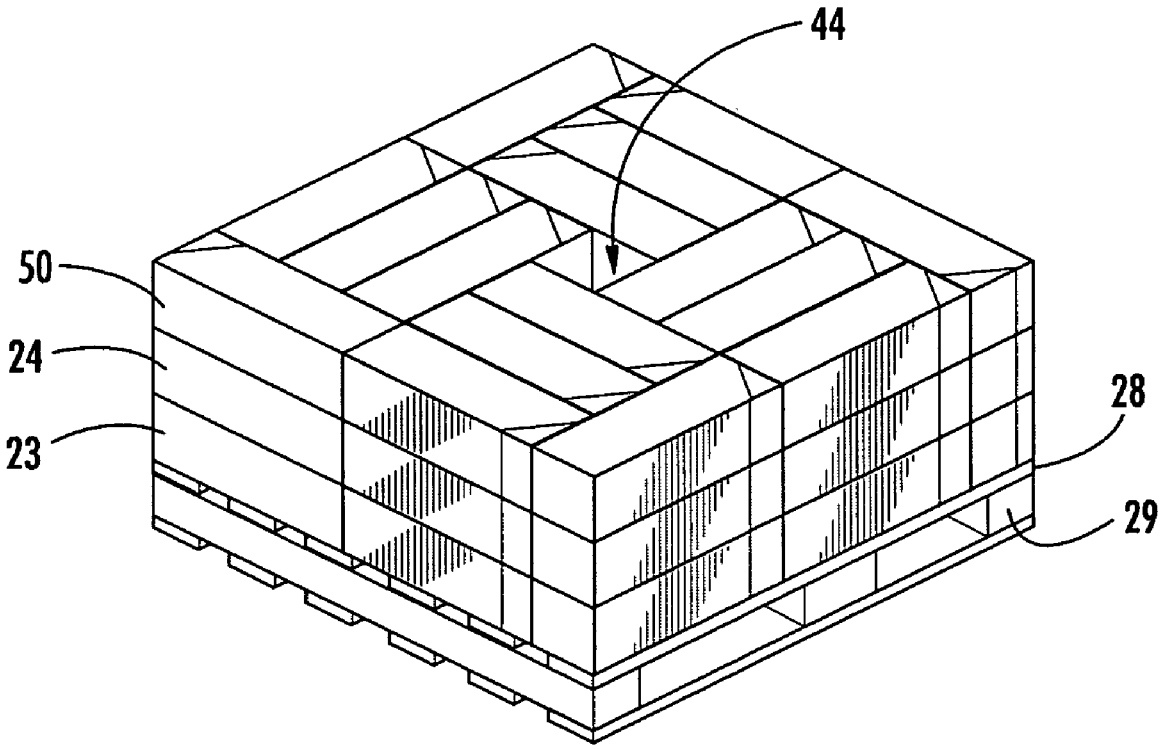

As illustrated in FIGS. 21 through 23, a composite carton 20 having three individual cartons may be constructed by positioning a plurality of first cartons 23 from the supply of first cartons onto an assembly surface 28, which may be a pallet 29. Adhesive is applied at predetermined adhesive locations 43 on each of the first cartons 23 on the assembly surface 28.

A plurality of second cartons 24 is positioned adjacent to the plurality of first cartons 23 on the assembly surface 28. Adhesive is then applied at predetermined adhesive locations 43 on each second carton 24 on the assembly surface 28.

A plurality of third cartons 50 is positioned from the supply of third cartons 51 adjacent to the plurality of second cartons 24 on the assembly surface 28.

As described above, successive carton layers positioned on the assembly surface 28 may be coextensive with or not coextensive with carton layers previously deposited on the assembly surface. Also as discussed above, a glue detector 45 may be used to detect the presence or absence of adhesive at each adhesive location 43.

The process described above may be repeated a plurality of times. If the invention is used to construct the composite carton 20 of the type described in U.S. Patent Application No. U.S. 2002/0185499 A1, then the individual cartons may be advantageously positioned on the assembly surface 28 in the pattern illustrated in FIGS. 21 through 23, which includes a void 44 and respective layers of first cartons 23, second cartons 24, and third cartons 50. The pinwheel arrangement of successive layers of composite cartons 20 that was illustrated in FIGS. 6 through 17 with respect to composite carton having only a first carton 23 adhered to a second carton 24 may also be used when constructing composite layers having a first carton 23 adhered to a second carton 24 adhered to a third carton 50.

Figure 24:
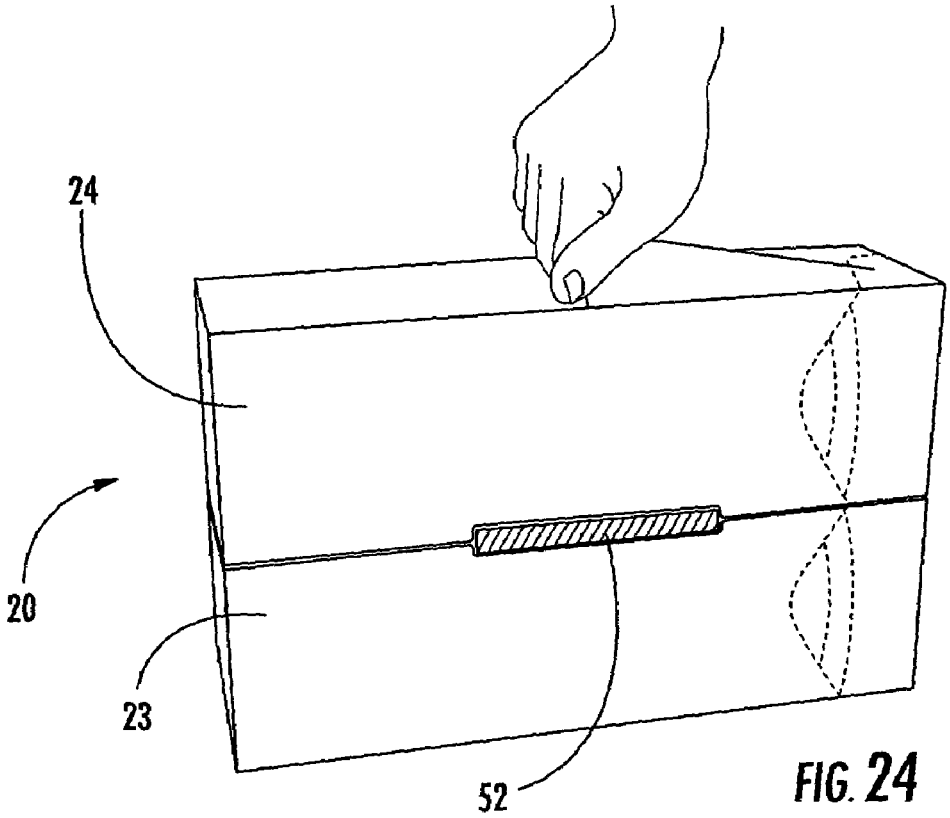
FIG. 24 is a perspective view illustrating a composite carton that can be made according to the present invention from two separate individual cartons having an object between the discreet cartons.
Figure 25:
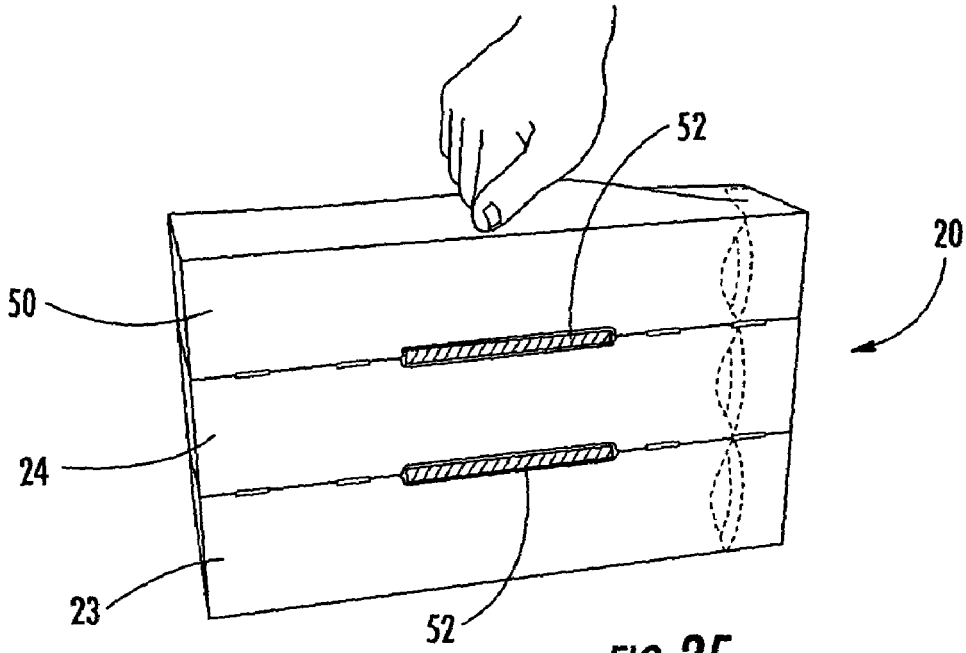
FIG. 25 is a perspective view illustrating a composite carton that can be made according to the present invention from three separate individual cartons having an object between each of the discreet cartons.

As indicated in FIG. 24 and FIG. 25, the present invention may be utilized to create a composite carton in which an object 52 is positioned between a first carton 23 and a second carton 24 or to produce a composite carton 20 in which an object 52 is positioned between a first carton 23 and a second carton 24 and between a second carton 24 and a third carton 50.

While the present invention is not restricted to use with any particular object 52, objects selected for use in the composite cartons of the present invention should be of a size and shape relative to the first, second and third cartons so as not to interfere with the integrity of the composite carton and so as not to interfere with the separation of individual cartons the composite cartons constructed are the separable type. Objects selected for inclusion in the composite carton should also be able to withstand the weight of the cartons and their contents during construction of a plurality of cartons and during shipment and handling by the ultimate end user of the composite cartons. Particularly suitable objects 52 for use in the present invention include CDs, DVDs, printed materials and promotional materials.

The method of constructing a composite carton illustrated in FIG. 24 is the same as previously described with respect to FIGS. 6 through 17 except that a plurality of objects 52 are positioned on each first carton 23 before a plurality of second cartons 24 are positioned adjacent to the first cartons 23. The objects 52 can be placed on the first cartons 23 at predetermined positions selected so as not to interfere with the predetermined adhesive locations 43, in which case the objects are held between the first cartons 23 and the second cartons 24 by frictional engagement with the first and second cartons that are adhered to each other. Alternatively, the objects 52 may be placed on one or more adhesive locations 43 on the first cartons 23 in order to adhere the objects 52 to the first cartons 23. In the event that the later embodiment is utilized, the adhesive used should be selected so that the objects 52 can be easily separated from the first cartons 23.

The method of constructing composite carton 20 illustrated in FIG. 25 is identical to the method described with respect to FIGS. 19 through 23 with the exception that an object 52 is placed adjacent to each first carton 23 on the assembly surface 28 prior to the plurality of second cartons 24 being placed adjacent to the first cartons 23 on the assembly surface and an object 52 is placed adjacent to each second carton 24 on the assembly surface 28 prior to the plurality of third cartons 50 being positioned adjacent to the second cartons 24. As previously described, the objects 52 may be placed on the first cartons 23 or the second cartons 24 at locations in which they do not interfere with the predetermined adhesive locations or, alternatively, in locations corresponding to one or more of the adhesive locations 43.

As is apparent from the discussion above, the present invention advantageously provides a method of simultaneously constructing a plurality of composite cartons and of constructing such composite cartons on an assembly surface such as a pallet that facilitates the easy and efficient movement of composite cartons and the products therein away from the manufacturing line and into the distribution process.

It will be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method of simultaneously making on a common assembly surface a plurality of composite cartons each comprised of a first singular carton adhered to a second singular carton, comprising the steps of:

positioning a plurality of first singular cartons in a predetermined array on the assembly surface;

positioning adhesive at one or more predetermined adhesive locations on each first singular carton in the array of first cartons on the assembly surface;

detecting the presence or absence of adhesive at each adhesive location after adhesive is deposited on each first singular carton; and positioning a plurality of second singular cartons en masse in a predetermined array adjacent to the array of first singular cartons on the assembly surface such that the adhesive at each adhesive location on each first singular carton contacts and bonds with a respectively corresponding second singular carton in the array of second singular cartons.

2. A method of simultaneously making a plurality of composite cartons as defined in claim 1 comprising the additional step of applying additional adhesive on one or more first singular cartons in response to detection of the absence of adhesive at each predetermined adhesive locations.

3. A method of simultaneously making a plurality of composite cartons as defined in claim 2 comprising the additional step of activating an alarm in response to detection of the absence of adhesive at each predetermined adhesive locations.

4. A method of simultaneously making a plurality of composite cartons as defined in claim 1 wherein the adhesive contains material reactive to light and the presence or absence of adhesive at each predetermined adhesive location is detected using an apparatus capable of detecting the reaction of such material to light.

5. A method of simultaneously making on a common assembly surface a plurality of composite cartons each comprised of a first singular carton adhered to a second singular carton, comprising the steps of:

positioning a plurality of first singular cartons in a predetermined array on the assembly surface;

positioning adhesive at one or more predetermined adhesive locations on each first singular carton in the array of first singular cartons on the assembly surface; and positioning a plurality of second singular cartons en masse in a predetermined array adjacent to the array of first singular cartons on the assembly surface to thereby simultaneously make a plurality of composite cartons, the plurality of second singular cartons being positioned en masse in a predetermined array adjacent to the array of first singular cartons on the assembly surface such that the adhesive at each adhesive location on each first singular carton contacts and bonds with a respectively corresponding second singular carton in the array of second singular cartons, each first singular carton in the plurality of first singular cartons is adhered to only one second singular carton, no first singular carton in the plurality of first singular cartons is adhered to any other first singular carton in the plurality of first singular cartons, each second singular carton in the plurality of second singular cartons is adhered to only one first singular carton in the plurality of first singular cartons, no second singular carton in the plurality of second singular cartons is adhered to any other second singular carton in the plurality of second singular cartons, and each first singular carton in the plurality of first singular cartons remains joined to a corresponding second singular carton in the plurality of second singular cartons when the corresponding second singular carton is lifted from the assembly surface.

6. A method of simultaneously making a plurality of composite cartons as defined in claim 5 comprising the additional steps of:

positioning an additional plurality of first singular cartons in a predetermined array adjacent to the array of second singular cartons on the assembly surface;

positioning adhesive at one or more predetermined adhesive locations on each first singular carton in the additional plurality of first singular cartons; and positioning an additional plurality of second singular cartons en masse in a predetermined array adjacent the array formed by the additional plurality of first singular cartons such that the adhesive at each adhesive location on each singular first carton in the additional plurality of first singular cartons on the assembly surface contacts and bonds with a respectively corresponding second singular carton in the predetermined array of the additional plurality of second singular cartons, each first singular carton in the additional plurality of first singular cartons is adhered to only one second singular carton in the additional plurality of second singular cartons, no first singular carton in the additional plurality of first singular cartons is adhered to any other first singular carton in the additional plurality of first singular cartons, each second singular carton in the additional plurality of second singular cartons is adhered to only one first singular carton in the additional plurality of first singular cartons, no second singular carton in the additional plurality of second singular cartons is adhered to any other second singular carton in the additional plurality of second singular cartons, and each first singular carton in the additional plurality of first singular cartons remains joined to a corresponding second singular carton in the additional plurality of second singular cartons when the corresponding second singular carton in the additional plurality of second singular cartons is lifted from the assembly surface.

7. A method of simultaneously making a plurality of composite cartons as defined in claim 6 wherein the additional steps are repeated a plurality of times.

8. A method of simultaneously making a plurality of composite cartons as defined in claim 6 wherein the quantity of first singular cartons on the assembly surface equals the quantity of second singular cartons on the assembly surface upon completion of the method steps.

9. A method of simultaneously making a plurality of composite cartons as defined in claim 5 comprising the additional step of positioning an object on each first singular carton in the array of first singular cartons on the assembly surface before positioning the plurality of second singular cartons en masse in a predetermined array adjacent to the array of first singular cartons on the assembly surface to form a plurality of composite cartons having a first singular carton adhered to a second singular carton with an object therebetween on the assembly surface.

10. A method of simultaneously making a plurality of composite cartons as defined in claim 5 wherein the first singular carton in each composite carton is separable from the corresponding second singular carton in each composite carton without substantially degrading the structural integrity of either the first singular carton or the second singular carton.

11. A method of simultaneously making a plurality of composite cartons as defined in claim 6 wherein a separating force between the first singular carton and second singular carton in each composite carton of about 20 to 22 pounds is required to separate the first singular carton from the second singular carton.

12. A method of simultaneously making a plurality of composite cartons as defined in claim 5 wherein the array in which the plurality of second singular cartons are positioned on the assembly surface is substantially identical to the array in which the plurality of first singular cartons are positioned on the assembly surface.

13. A method of simultaneously making a plurality of composite cartons as defined in claim 5 wherein the assembly surface is a pallet.

14. A method of simultaneously making a plurality of composite cartons as defined in claim 5 wherein the assembly surface is a conveyor.

15. A method of simultaneously making a plurality of composite cartons as defined in claim 5 wherein the assembly surface is one or more chains.

16. A method of simultaneously making a plurality of composite cartons as defined in claim 5 wherein each first singular carton and each second singular carton contain products before being positioned on the assembly surface.

17. A method of simultaneously making a plurality of composite cartons as defined in claim 5 wherein the products contained in each first singular carton differ from the products contained in each second singular carton.

18. A method of simultaneously making a plurality of composite cartons as defined in claim 5 wherein the products contained in each first singular carton are identical to the products contained in each second singular carton.

19. A method of simultaneously making a plurality of composite cartons as defined in claim 5 comprising the additional step of detecting the presence or absence of adhesive at each adhesive location after adhesive is deposited on each first singular carton.

20. A method of simultaneously making a plurality of composite cartons as defined in claim 19 comprising the additional step of applying additional adhesive on one or more first singular cartons in response to detection of the absence of adhesive at each predetermined adhesive locations.

21. A method of simultaneously making a plurality of composite cartons as defined in claim 19 comprising the additional step of activating an alarm in response to detection of the absence of adhesive at each predetermined adhesive locations.

22. A method of simultaneously making a plurality of composite cartons as defined in claim 19 wherein the adhesive contains material reactive to light and the presence or absence of adhesive at each predetermined adhesive location is detected using an apparatus capable of detecting the reaction of such material to light.

23. A method of simultaneously making a plurality of composite cartons as defined in claim 5 comprising the additional step of making one or more cuts in the surface of each first singular carton at the predetermined adhesive locations prior to the positioning of adhesive at the predetermined adhesive locations.

24. A method of simultaneously making on a pallet a plurality of composite cartons each comprised of a first singular carton adhered to a second singular carton, comprising the steps of:

providing a supply of first singular cartons stacked in layers, each layer having a plurality of first singular cartons;

providing a supply of second singular cartons stacked in layers, each layer having a plurality of second singular cartons;

positioning a layer of first singular cartons from the supply of first singular cartons on a pallet;

positioning adhesive at one or more predetermined adhesive locations on each first singular carton in the layer of first cartons on the pallet; and positioning en masse a layer of second singular cartons adjacent to the layer of first singular cartons on the pallet to thereby simultaneously make a plurality of composite cartons, the layer of second singular cartons being positioned en masse adjacent to the layer of first singular cartons such that each second singular carton is coextensive with a first singular carton, the adhesive at each adhesive location on each first singular carton contacts and bonds with a respectively corresponding second singular carton, each first singular carton in the layer of first singular cartons is adhered to only one second singular carton in the layer of second singular cartons, no first singular carton in the layer of first singular cartons is adhered to any other first singular carton in the layer of first singular cartons, each second singular carton in the layer of second singular cartons is adhered to only one first singular carton in the layer of first singular cartons, no second singular carton in the layer of second singular cartons is adhered to any other second singular carton in the layer of second singular cartons, and each first singular carton remains joined to a corresponding second singular carton when the corresponding second singular carton is lifted from the pallet.

25. A method of simultaneously making on a pallet a plurality of composite cartons as defined in claim 24 comprising the additional steps of:

positioning an additional layer of first singular cartons from the supply of first singular cartons adjacent to the layer of second singular cartons on the pallet such that no first singular carton in the additional layer of first singular cartons is coextensive with a second carton adjacent thereto;

positioning adhesive at one or more predetermined adhesive locations on each first singular carton in the additional layer of first cartons on the pallet; and positioning en masse an additional layer of second singular cartons from the supply of second singular cartons adjacent the additional layer of first singular cartons on the pallet such that each second singular carton in the additional layer of second singular cartons on the pallet is coextensive with a first singular carton adjacent thereto and such that the adhesive at each adhesive location on each first singular carton in the additional layer of first singular cartons contacts and bonds with a respectively coextensive second singular carton in the additional layer of second singular cartons, each first singular carton in the additional layer of first singular cartons is adhered to only one second singular carton in the additional layer of second singular cartons, no first singular carton in the additional layer of first singular cartons is adhered to any other first singular carton in the additional layer of first singular cartons, no second singular carton in the additional layer of second singular cartons is adhered to any other second singular carton in the additional layer of second singular cartons and each first singular carton in the additional layer of first singular cartons remains joined to a corresponding coextensive second singular carton in the additional layer of second singular cartons when the corresponding coextensive second singular carton in the additional layer of second singular cartons is lifted from the assembly surface.

26. A method of simultaneously making on a pallet a plurality of composite cartons as defined in claim 25 wherein the additional steps are repeated a plurality of times.

27. A method of simultaneously making on a pallet a plurality of composite cartons as defined in claim 24 wherein the first singular carton in each composite carton is separable from the corresponding second singular carton in each composite carton without substantially degrading the structural integrity of either the first singular carton or the second singular carton.

28. A method of simultaneously making a plurality of composite cartons as defined in claim 27 wherein an outward force between the first singular carton and second singular carton in each composite carton of approximately 20 to 22 pounds is required to separate the first singular carton from the second singular carton.

29. A method of simultaneously making on a pallet a plurality of composite cartons as defined in claim 24 wherein each first singular carton and each second singular carton contain products before being positioned on the pallet.

30. A method of simultaneously making on a pallet a plurality of composite cartons as defined in claim 29 wherein the products contained in each first singular carton differ from the products contained in each second singular carton.

31. A method of simultaneously making on a pallet a plurality of composite cartons as defined in claim 24 wherein each first singular carton in the supply of first singular cartons and each second singular carton in the supply of second singular cartons contains beverage products.

32. A method of simultaneously making on a pallet a plurality of composite cartons as defined in claim 24 wherein the positioning of layers of singular cartons is performed by a crane.

33. A method of simultaneously making on a pallet a plurality of composite cartons as defined in claim 24 wherein the positioning of layers of singular cartons is performed by a traveling crane supported by a gantry.

34. A method of simultaneously making on a pallet a plurality of composite cartons as defined in claim 24 wherein the positioning of layers of singular cartons is performed by a robot.

35. A method of simultaneously making on a pallet a plurality of composite cartons as defined in claim 34 wherein the supply of first singular cartons stacked in layers, the supply of second singular cartons stacked in layers, and the pallet are approximately equal distances from the robot.

36. A method of simultaneously making on a pallet a plurality of composite cartons as defined in claim 24 wherein the pallet is lowered after each layer of singular cartons is positioned thereon.

37. A method of simultaneously making on a pallet a plurality of composite cartons as defined in claim 24 wherein the supply of first singular cartons stacked in layers and the supply of second singular cartons stacked in layer are each raised after a layer of singular cartons is removed therefrom.

38. A method of simultaneously making on a pallet a plurality of composite cartons as defined in claim 24 comprising the additional step of detecting the presence or absence of adhesive at each adhesive location after adhesive is deposited on each first singular carton.

39. A method of simultaneously making on a pallet a plurality of composite cartons as defined in claim 38 comprising the additional step of applying additional adhesive on one or more first singular cartons in response to detection of the absence of adhesive at each predetermined adhesive locations.

40. A method of simultaneously making on a pallet a plurality of composite cartons as defined in claim 38 comprising the additional step of activating an alarm in response to detection of the absence of adhesive at each predetermined adhesive locations.

41. A method of simultaneously making on a common assembly surface a plurality of composite cartons each comprised of a first singular carton adhered to a second singular carton adhered to a third singular carton, comprising the steps of:

positioning a plurality of first singular cartons in a predetermined array of first singular cartons onto an assembly surface;

positioning adhesive at one or more predetermined adhesive locations on each first singular carton in the array of first singular cartons on the assembly surface;

positioning a plurality of second singular cartons en masse in a predetermined array adjacent to the array of first singular cartons on the assembly surface such that the adhesive at each adhesive location on each first singular carton contacts and bonds with a respectively corresponding second singular carton;

positioning adhesive at one or more predetermined adhesive locations on each second singular carton in the array of second singular cartons on the assembly surface; and positioning a plurality of third singular cartons en masse in a predetermined array adjacent to the array of second singular cartons on the assembly surface to simultaneously make a composite carton, the plurality of third singular cartons being positioned en masse in a predetermined array adjacent to the array of second singular cartons such that the adhesive at each adhesive location on each second singular carton contacts and bond with a respectively corresponding third singular carton, each first singular carton in the plurality of first singular cartons is adhered to only one second singular carton in the plurality of second singular cartons, each second singular carton in the plurality of second singular cartons is adhered to only one first singular carton in the plurality of first singular cartons and one third singular carton in the plurality of third singular cartons, each third singular carton in the plurality of third singular cartons is adhered only to one second singular carton in the plurality or second singular cartons and each first singular carton remains joined to a corresponding second singular carton that remains joined to a corresponding third singular carton when the corresponding third singular carton is lifted from the assembly surface.

42. A method of simultaneously making a plurality of composite cartons as defined in claim 41 comprising the additional steps of:

positioning an additional plurality of first singular cartons in a predetermined array adjacent to the array of third singular cartons on the assembly surface;

positioning adhesive at one or more predetermined adhesive locations on each first singular carton in the additional array of first cartons on the assembly surface;

positioning en masse an additional plurality of second singular cartons adjacent to the array of additional first singular cartons such that the adhesive at each adhesive location on each first singular carton of the additional array of first singular cartons contacts and bonds with a respectively corresponding second singular carton in the additional array of second singular cartons;

positioning adhesive at one or more predetermined adhesive locations on each second singular carton in the additional array of second singular cartons; and positioning en masse an additional plurality of third singular cartons adjacent to the array of additional second singular cartons such that the adhesive at each adhesive location on each second singular carton of the additional array of second cartons contacts and bonds with a respectively corresponding third singular carton in the additional array of third singular cartons, each first singular carton in the additional plurality of first singular cartons is adhered to only one second singular carton in the additional plurality of second singular cartons, each second singular carton in the additional plurality of second singular cartons is adhered to only one first singular carton in the additional plurality of first singular cartons and one third singular carton in the additional plurality of third singular cartons, each third singular carton in the additional plurality of third singular cartons is adhered only to one second singular carton in the additional plurality of second singular cartons and each first singular carton in the additional array of first singular cartons remains joined to a corresponding second singular carton in the additional array of second singular cartons that remains joined to a corresponding third singular carton in the additional array of third singular cartons when the corresponding third singular carton is lifted from the assembly surface.

43. A method of simultaneously making a plurality of composite cartons as defined in claim 42 wherein the additional steps are repeated a plurality of times.

* * * * *